US011473821B2

(12) United States Patent
Wada et al.

(10) Patent No.: US 11,473,821 B2
(45) Date of Patent: Oct. 18, 2022

(54) REFRIGERATION CYCLE APPARATUS

(71) Applicant: Mitsubishi Electric Corporation, Tokyo (JP)

(72) Inventors: Makoto Wada, Tokyo (JP); Takuya Matsuda, Tokyo (JP); Katsuhiro Ishimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 171 days.

(21) Appl. No.: 16/621,948

(22) PCT Filed: Aug. 10, 2017

(86) PCT No.: PCT/JP2017/029048
§ 371 (c)(1),
(2) Date: Dec. 12, 2019

(87) PCT Pub. No.: WO2019/030885
PCT Pub. Date: Feb. 14, 2019

(65) Prior Publication Data
US 2020/0166257 A1 May 28, 2020

(51) Int. Cl.
*F25B 49/02* (2006.01)
*F25B 13/00* (2006.01)
*F25B 1/00* (2006.01)

(52) U.S. Cl.
CPC ..... *F25B 49/02* (2013.01); *F25B 13/00* (2013.01); *F25B 1/00* (2013.01);
(Continued)

(58) Field of Classification Search
CPC .. F25B 49/02; F25B 13/00; F25B 1/00; F25B 2313/02741; F25B 2313/0314;
(Continued)

(56) References Cited

U.S. PATENT DOCUMENTS

2005/0103029 A1* 5/2005 Kawahara ..... F25D 29/008 62/126
2018/0180338 A1* 6/2018 Honda ..... F25B 49/02
2019/0195550 A1* 6/2019 Sakae ..... F25B 13/00

FOREIGN PATENT DOCUMENTS

EP 3 279 580 A1 2/2018
JP S59-100375 A 6/1984
(Continued)

OTHER PUBLICATIONS

Ariki et al., Controller for Air Conditioner, Jun. 16, 2000, JP2000161799A, Whole Document (Year: 2000).*
(Continued)

*Primary Examiner* — Larry L Furdge
(74) *Attorney, Agent, or Firm* — Posz Law Group, PLC

(57) ABSTRACT

Upon detection of a leakage of refrigerant, a refrigerant recovery operation is performed for operating a compressor in a state where an outdoor expansion valve is closed. The refrigerant suctioned from an indoor unit passes through an outdoor heat exchanger so as to be liquefied and accumulated in an outdoor unit. When a low-pressure detection value by a pressure sensor decreases below a reference value, a termination condition for the refrigerant recovery operation is satisfied, and the compressor is stopped. Furthermore, when an abnormality in the refrigerant recovery operation is detected based on a behavior of the low-pressure detection value obtained until the termination condition is satisfied, the compressor is stopped to thereby end the refrigerant recovery operation. Also, guidance information for notification about an abnormality is output to a user.

15 Claims, 10 Drawing Sheets

(52) U.S. Cl.
CPC ..... *F25B 2313/02741* (2013.01); *F25B 2313/0314* (2013.01); *F25B 2400/0401* (2013.01); *F25B 2500/222* (2013.01); *F25B 2600/2501* (2013.01); *F25B 2600/2513* (2013.01); *F25B 2700/1931* (2013.01); *F25B 2700/1933* (2013.01); *F25B 2700/21152* (2013.01)

(58) Field of Classification Search
CPC ..... F25B 2400/0401; F25B 2500/222; F25B 2600/2513; F25B 2700/1931; F25B 2700/1933; F25B 2700/21152; F25B 2600/23; F25B 2600/01; F25B 2700/2108; F25B 2313/0315; F25B 2600/2519; F25B 2400/16; F25B 49/005; F25B 2313/0233
See application file for complete search history.

(56) References Cited

FOREIGN PATENT DOCUMENTS

| | | | | |
|---|---|---|---|---|
| JP | 2000-161798 | A | | 6/2000 |
| JP | 2000161799 | A | * | 6/2000 |
| JP | 2002-228281 | A | | 8/2002 |
| JP | 2004-286315 | A | | 10/2004 |
| JP | 2007-178026 | A | | 7/2007 |
| JP | 2009-222272 | A | | 10/2009 |
| JP | 2013-122364 | A | | 6/2013 |
| JP | 2016-011783 | A | | 1/2016 |
| JP | 2017067428 | A | * | 4/2017 |
| WO | 2013/038704 | A1 | | 3/2013 |
| WO | 2016/157519 | A1 | | 10/2016 |

OTHER PUBLICATIONS

Ikemiya et al., Refrigeration Device, Jun. 4, 2017, JP2017067428A, Whole Document (Year: 2017).*

Extended European Search Report dated Jun. 2, 2020 in the corresponding EP patent application No. 17920952.3.

International Search Report of the International Searching Authority dated Nov. 7, 2017 for the corresponding International application No. PCT/JP2017/029048 (and English translation).

* cited by examiner

| TEMPERATURE CONDITION (Tot, Tra, Trb) | AMOUNT OF SEALED REFRIGERANT | REFERENCE CHANGE CHARACTERISTIC fr(t) | REFERENCE TIME PERIOD ts |
|---|---|---|---|
| A | M1 | f11(t) | ts11 |
| B | | f12(t) | ts12 |
| C | | f13(t) | ts13 |
| ⋮ | | ⋮ | ⋮ |
| A | M2 | f21(t) | ts21 |
| B | | f22(t) | ts22 |
| C | | f23(t) | ts23 |
| ⋮ | | ⋮ | ⋮ |

HIGH
LOW
LARGE
SMALL

REFRIGERATION CYCLE APPARATUS

CROSS REFERENCE TO RELATED APPLICATION

This application is a U.S. national stage application of International Application PCT/JP2017/029048, filed on Aug. 10, 2017, the contents of which are incorporated herein by reference.

TECHNICAL FIELD

The present invention relates to a refrigeration cycle apparatus, and particularly to a refrigeration cycle apparatus having a function of detecting a leakage of refrigerant.

BACKGROUND

In a refrigeration cycle apparatus, air conditioning is performed by heat exchange accompanied with liquefaction (condensation) and vaporization (evaporation) of circulating refrigerant that is sealed therein. Japanese Patent Laying-Open No. 2002-228281 (PTL 1) discloses that, when a leakage of refrigerant is detected in a room in which an indoor unit is installed, a compressor and an outdoor blower fan are operated in the state where an on-off valve for interrupting the flow of liquid refrigerant is closed, thereby recovering the refrigerant in a receiver tank and a heat exchanger in an outdoor unit.

The similar refrigerant recovery operation (a pump down operation) is disclosed also in Japanese Patent Laying-Open No. 2016-11783 (PTL 2), Japanese Patent Laying-Open No. 2013-122364 (PTL 3), and Japanese Patent Laying-Open No. 2004-286315 (PTL 4).

PATENT LITERATURE

PTL 1: Japanese Patent Laying-Open No. 2002-228281
PTL 2: Japanese Patent Laying-Open No. 2016-11783
PTL 3: Japanese Patent Laying-Open No. 2013-122364
PTL 4: Japanese Patent Laying-Open No. 2004-286315

According to the disclosure in PTL 1, during recovery of refrigerant, when a pressure detector disposed downstream of an on-off valve located downstream of a receiver tank detects a prescribed pressure in a cooling operation, the compressor is stopped to end the pump down operation.

However, PTL 1 to PTL 4 each disclose the termination condition for the pump down operation but do not particularly disclose abnormality detection performed until the termination condition is satisfied by a pressure decrease or the like resulting from recovery of refrigerant.

Accordingly, when a certain abnormality, for example, a failure or the like in a compressor, an outdoor blower fan, a pressure detector, or an on-off valve occurs during a pump down operation, the recovery of refrigerant is not normally completed. Thus, the pump down operation may be continuously performed while the termination condition remains unsatisfied. Such a situation may cause a concern that a user cannot be appropriately notified about an abnormality.

SUMMARY

The present disclosure has been made to solve the above-described problems. An object of the present disclosure is to provide appropriate user guidance in a refrigerant recovery operation started upon detection of a leakage of refrigerant in a refrigeration cycle apparatus including a refrigerant leakage sensor.

In an aspect of the present disclosure, a refrigeration cycle apparatus equipped with an outdoor unit and at least one indoor unit includes: a compressor; an outdoor heat exchanger provided in the outdoor unit; an indoor heat exchanger provided in the indoor unit; a refrigerant pipe; a first interruption mechanism; a leakage sensor for refrigerant; and an information output unit configured to output information to a user. The refrigerant pipe is configured to connect the compressor, the outdoor heat exchanger, and the indoor heat exchanger. The first interruption mechanism is provided in a path that connects the outdoor heat exchanger and the indoor heat exchanger without passing through the compressor in a refrigerant circulation path that has the compressor, the outdoor heat exchanger, the indoor heat exchanger, and the refrigerant pipe. The leakage sensor is configured to detect a leakage of refrigerant that flows through the refrigerant pipe. When the leakage sensor detects a leakage of the refrigerant, a refrigerant recovery operation is performed until a termination condition based on a predetermined state amount is satisfied. In the refrigerant recovery operation, the first interruption mechanism interrupts a flow of the refrigerant and the compressor is operated in a state where the refrigerant circulation path is formed in a direction in which the refrigerant discharged from the compressor passes through the outdoor heat exchanger and subsequently passes through the indoor heat exchanger. When an abnormality in the refrigerant recovery operation is detected during the refrigerant recovery operation, the information output unit outputs guidance information for notifying the user about the abnormality.

According to the present disclosure, appropriate user guidance can be provided in a refrigerant recovery operation started upon detection of a leakage of refrigerant in a refrigeration cycle apparatus including a refrigerant leakage sensor.

DETAILED DESCRIPTION

Figure 1:
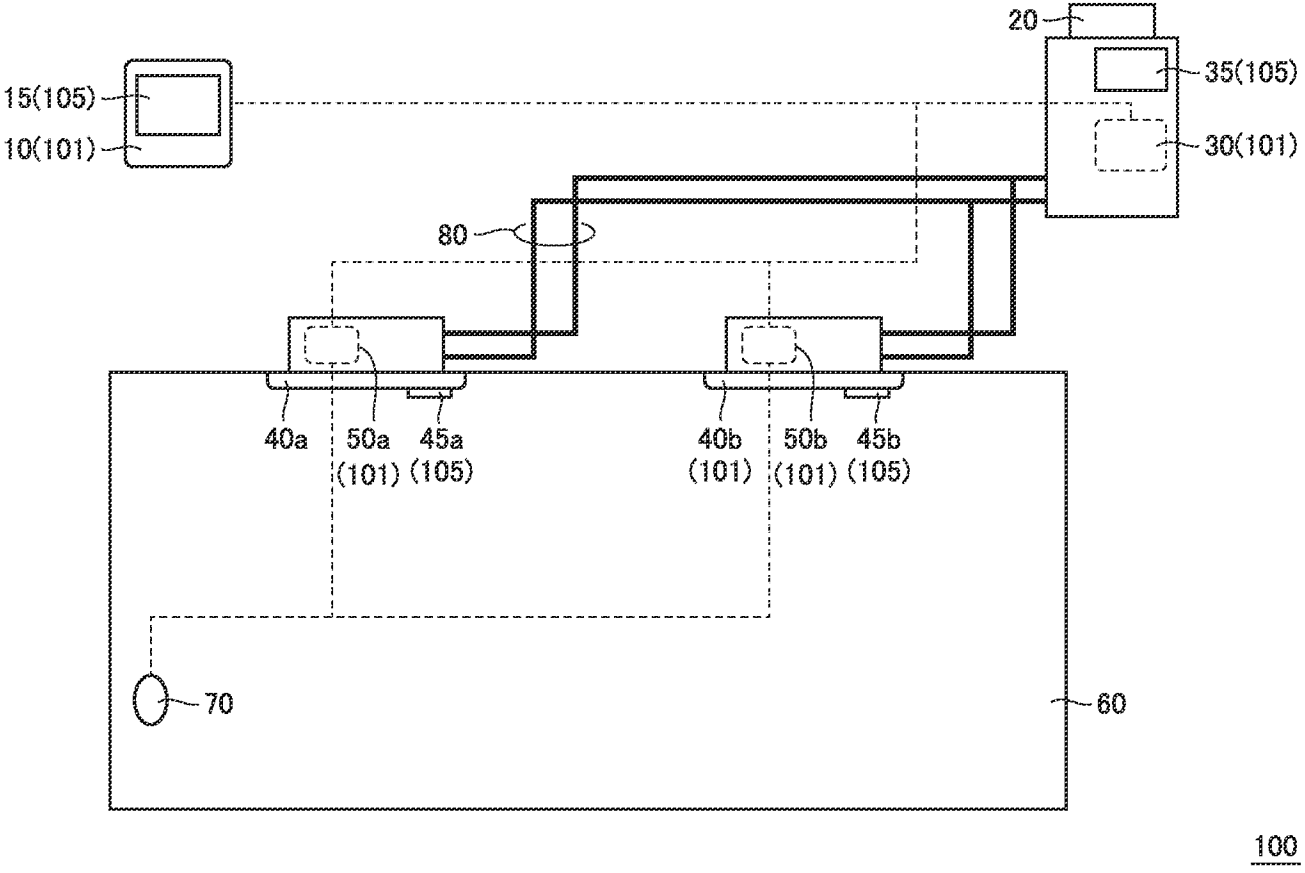
FIG. 1 is a block diagram illustrating the configuration of an air conditioning system to which a refrigeration cycle apparatus according to an embodiment of the present disclosure is applied.

The embodiments of the present invention will be hereinafter described in detail with reference to the accompanying drawings. In the following description, the same or corresponding components in the accompanying drawings will be designated by the same reference characters, and description thereof will not be basically repeated.

First Embodiment

FIG. 1 is a block diagram illustrating the configuration of an air conditioning system to which a refrigeration cycle apparatus according to the present embodiment is applied.

Referring to FIG. 1, an air conditioning system 100 includes an outdoor unit 20, a plurality of indoor units 40*a* and 40*b*, and a refrigerant pipe 80. Indoor units 40*a* and 40*b* are disposed in a target space 60 for air conditioning. Target space 60 is a living room in a house, a building or the like, for example. Refrigerant pipe 80 is formed of a copper pipe, for example, and connects outdoor unit 20 to indoor units 40*a* and 40*b*.

Outdoor unit 20 includes an outdoor unit controller 30. Indoor units 40*a* and 40*b* include indoor unit controllers 50*a* and 50*b*, respectively. Each of outdoor unit controller 30 and indoor unit controllers 50*a* and 50*b* can be formed of a microcomputer including a central processing unit (CPU), memory such as a random access memory (RAM) and a read only memory (ROM), and an input/output interface, and the like, each of which is not shown.

Air conditioning system 100 further includes an air conditioning system controller 10. Air conditioning system controller 10 can be formed of a remote controller into which a user command can be input. Examples of the user command may include commands to start and stop an operation, a command to set a timer operation, a command to select an operation mode, a command to set a temperature, and the like.

For example, air conditioning system controller 10 can be disposed in target space 60 or an operation management room in which a maintenance manager stays for centralized control of the plurality of target spaces 60. Air conditioning system controller 10 can be configured such that a user (for example, including a maintenance manager and a serviceman) can input, thereinto, not only the command to operate outdoor unit 20 or indoor units 40*a* and 40*b* but also the command to operate the entire refrigeration cycle apparatus.

The microcomputer (not shown) stored in air conditioning system controller 10 is configured to be capable of bidirectionally transmitting and receiving data to and from outdoor unit controller 30, indoor unit controllers 50*a* and 50*b*. Furthermore, air conditioning system controller 10 includes an information output unit 15 configured to output a message in at least one of a visual manner and an auditory manner for notifying a user about information. Information output unit 15 is configured, for example, to include at least one of a display screen such as a liquid crystal panel and a speaker. The operation of information output unit 15 is controlled by the microcomputer of air conditioning system controller 10. For example, information output unit 15 is provided on the surface or on the outside of the remote controller.

Furthermore, an information output unit 35 similar to information output unit 15 can be disposed so as to correspond to outdoor unit 20. Similarly, information output units 45*a* and 45*b* can be disposed so as to correspond to indoor units 40*a* and 40*b*, respectively. The operation of information output unit 35 can be controlled by outdoor unit controller 30. The operation of information output unit 45 (45*a*, 45*b*) can be controlled by indoor unit controllers 50*a* and 50*b*. In the following, these information output units will also be simply collectively referred to as an information output unit 105. Specifically, in the refrigeration cycle apparatus according to the present embodiment, at least one information output unit 105 is disposed so as to correspond to at least any one of air conditioning system controller 10, outdoor unit controller 30, and indoor unit controllers 50*a* and 50*b*.

Furthermore, the function of controlling each component of the refrigeration cycle apparatus according to the present embodiment is shared among air conditioning system controller 10, outdoor unit controller 30, and indoor unit controllers 50*a* and 50*b*. In the following, air conditioning system controller 10, outdoor unit controller 30, and indoor unit controllers 50*a* and 50*b* will be simply collectively referred to as a controller 101.

A refrigerant leakage sensor 70 is disposed in target space 60 for air conditioning. Refrigerant leakage sensor 70 detects the refrigerant gas concentration in atmosphere for the refrigerant used in the refrigeration cycle apparatus, for example. Representatively, refrigerant leakage sensor 70 can be configured to output a detection signal when the refrigerant gas concentration increases above a predetermined reference value. Alternatively, for detecting a decrease in the oxygen concentration caused by an increase in the refrigerant gas concentration, refrigerant leakage sensor 70 may be configured to output a detection signal when the oxygen concentration decreases below a reference value. The output from refrigerant leakage sensor 70 is transmitted to indoor unit controllers 50*a* and 50*b*, outdoor unit controller 30, and air conditioning system controller 10.

In the following explanation, indoor units 40*a* and 40*b* and elements thereof are denoted by reference numerals with no suffix when the description is common to the units; whereas indoor units 40*a* and 40*b* and elements thereof are denoted by reference numerals with suffixes a and b when the units are distinguished from each other. For example, each of indoor unit controllers 50*a* and 50*b* is also denoted simply as an indoor unit controller 50 in the description of the feature common to indoor unit controllers 50*a* and 50*b*.

In the configuration example in FIG. 1, indoor units 40*a* and 40*b* are disposed in a common target space 60, but a plurality of indoor units 40 may be disposed in different target spaces. In this case, it is preferable that refrigerant leakage sensor 70 is disposed in each target space. Refrigerant leakage sensor 70 can also be disposed in a duct or the like (not shown). Thus, refrigerant leakage sensor 70 can be disposed at any position without being limited to a position inside target space 60 as long as it can detect the refrigerant gas concentration.

Figure 2:
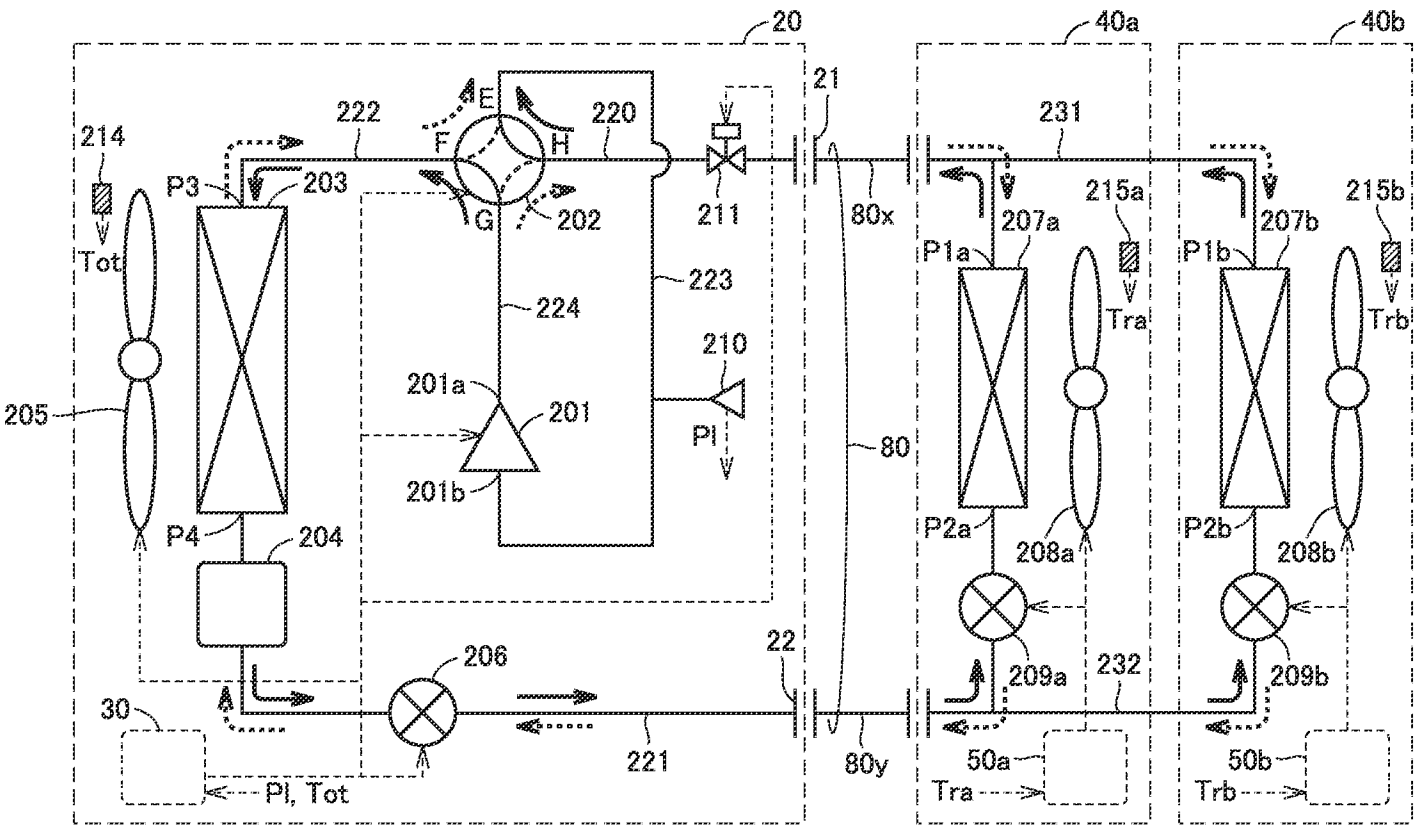
FIG. 2 is a block diagram illustrating the configuration of a refrigerant circuit in the refrigeration cycle apparatus according to the first embodiment.

FIG. 2 is a block diagram illustrating the configuration of a refrigerant circuit in the refrigeration cycle apparatus according to the first embodiment.

Referring to FIG. 2, the refrigeration cycle apparatus includes an outdoor unit 20 provided with: a compressor 201; a four-way valve 202; an outdoor heat exchanger 203; a high-pressure receiver 204; an outdoor fan 205; an outdoor expansion valve 206; an on-off valve 211; and pipes 220 to 224. Compressor 201, four-way valve 202, outdoor heat exchanger 203, high-pressure receiver 204, and outdoor expansion valve 206 are connected in this order through pipes 220 to 224. Also, refrigerant pipe 80 shown in FIG. 1 includes refrigerant pipes 80*x* and 80*y*.

Compressor 201 is configured to be capable of changing an operation frequency by the control signal from outdoor unit controller 30. By changing the operation frequency of compressor 201, the output from the compressor is adjusted. Compressor 201 may be of various types, for example, such as a rotary type, a reciprocating type, a scroll type, and a screw type as appropriate. Four-way valve 202 has ports E, F, G, and H. Outdoor heat exchanger 203 has ports P3 and P4.

The refrigeration cycle apparatus includes indoor unit 40 (40*a*, 40*b*) provided with: an indoor heat exchanger 207 (207*a*, 207*b*); an indoor fan 208 (208*a*, 208*b*); and an indoor expansion valve 209 (209*a*, 209*b*). Pipe 231, indoor heat exchanger 207*a*, indoor expansion valve 209*a*, and pipe 232 are connected in this order while pipe 231, indoor heat exchanger 207*b*, indoor expansion valve 209*b*, and pipe 232 are connected in this order. Indoor heat exchanger 207*a* and indoor expansion valve 209*a* are connected in parallel with indoor heat exchanger 207*b* and indoor expansion valve 209*b*. Indoor heat exchanger 207*a* has ports P1*a* and P2*a*. Indoor heat exchanger 207*b* has ports P1*b* and P2*b*.

Each of outdoor expansion valve 206 and indoor expansion valves 209*a* and 209*b* can be formed of an electronic expansion valve (LEV) having a degree of opening that is electronically controlled. In indoor unit 40, according to the control signal from indoor unit controller 50 (50*a*, 50*b*), the degree of opening of indoor expansion valve 209 (209*a*, 209*b*) is controlled to be: fully opened; SH (superheat: degree of superheat)-controlled; SC (subcool: degree of supercooling)-controlled; or closed (fully closed). Similarly, the degree of opening of outdoor expansion valve 206 is controlled by outdoor unit controller 30, for example, so as to include degrees to be fully opened and fully closed.

In indoor unit 40, indoor unit controller 50 (50*a*, 50*b*) controls: the operation of indoor fan 208 (208*a*, 208*b*) to be stopped and started; and the rotation speed of indoor fan 208 (208*a*, 208*b*) during the operation. Furthermore, in outdoor unit 20, outdoor unit controller 30 controls: the operation of compressor 201 to be stopped and started; the frequency of compressor 201 during the operation; the operation of outdoor fan 205 to be stopped and started; the rotation speed of outdoor fan 205 during the operation; the state of four-way valve 202; and on-off valve 211 to be opened or closed.

In outdoor unit 20, pipe 220 connects port H of four-way valve 202 and a gas-side refrigerant pipe connection hole 21 of outdoor unit 20. Pipe 220 is provided with on-off valve 211. On the outside of outdoor unit 20, one end of refrigerant pipe 80*x* is connected to gas-side refrigerant pipe connection hole 21. The other end of refrigerant pipe 80*x* is connected through pipe 231 on the indoor unit 40 side to port P1*a* on one side of indoor heat exchanger 207*a* and port P1*b* on one side of indoor heat exchanger 207*b*.

On the inside of indoor unit 40, indoor heat exchanger 207 and indoor expansion valve 209 are connected in series between pipes 231 and 232. In the configuration example in FIG. 2, indoor heat exchanger 207*a* and indoor expansion valve 209*a* are connected between pipes 231 and 232 on the inside of indoor unit 40*a* while indoor heat exchanger 207*b* and indoor expansion valve 209*b* are connected between pipes 231 and 232 on the inside of indoor unit 40*b*. Pipe 232 of indoor unit 40 is connected through refrigerant pipe 80*y* to a liquid-side refrigerant pipe connection hole 22 of the outdoor unit.

In outdoor unit 20, pipe 221 connects liquid-side refrigerant pipe connection hole 22 of the outdoor unit and port P4 of outdoor heat exchanger 203. Pipe 221 is provided with high-pressure receiver 204 and outdoor expansion valve 206. High-pressure receiver 204 is connected between port P4 and outdoor expansion valve 206.

Pipe 222 connects port P3 of outdoor heat exchanger 203 and port F of four-way valve 202. Pipe 223 connects port E of four-way valve 202 and a suction side 201*b* of compressor 201. Pipe 224 connects a discharge side 201*a* of compressor 201 and port G of four-way valve 202. In this way, refrigerant pipe 80 (80*x*, 80*y*) and pipes 220 to 225, 231, and 232 can constitute a "refrigerant pipe" through which compressor 201, outdoor heat exchanger 203, and indoor heat exchanger 207 are connected in a circulation manner.

On pipe 223, a pressure sensor 210 for detecting the pressure on the suction side (the low-pressure side) of compressor 201 is disposed. A detection value Pl by pressure sensor 210 (hereinafter also referred to as a low-pressure detection value Pl) is input into outdoor unit controller 30.

Outdoor unit 20 is provided with a temperature sensor 214 for detecting an atmospheric temperature. Similarly, indoor units 40*a* and 40*b* are provided with temperature sensors 215*a* and 215*b*, respectively, for sensing the atmospheric temperature. A detection temperature Tot by temperature sensor 214 is input into outdoor unit controller 30. Detection temperatures Tra and Trb by temperature sensors 215*a* and 215*b* are input into indoor unit controllers 50*a* and 50*b*, respectively.

Then, a refrigerant circulation path in the refrigeration cycle apparatus will be described.

Four-way valve 202 is controlled by the signal from outdoor unit controller 30 to bring about the first state (cooling operation state: state 1) and the second state (heating operation state: state 2). In the first state, port G is in communication with port F while port E is in communication with port H. In the second state, port G is in communication with port H while port E is in communication with port F. In other words, port E corresponds to the "first port", port F corresponds to the "second port", port G corresponds to the "third port", and port H corresponds to the "fourth port".

When compressor 201 is operated while four-way valve 202 is in state 1 (cooling operation state), the refrigerant circulation path is formed in the direction indicated by solid line arrows in FIG. 2. Specifically, the refrigerant that has been changed into high-temperature, high-pressure vapor by compressor 201 is condensed (liquefied) as a result of heat radiation in outdoor heat exchanger 203 when the refrigerant flows through pipes 224 and 222 and passes through outdoor heat exchanger 203. The condensed refrigerant passes through pipe 221, high-pressure receiver 204, and outdoor expansion valve 206, and then passes through refrigerant pipe 80*y* so as to be delivered to indoor unit 40.

In indoor unit 40, the refrigerant is evaporated (vaporized) as a result of heat absorption in indoor heat exchanger 207 when the refrigerant flows through pipe 232 and indoor expansion valve 209 and then passes through indoor heat exchanger 207. The vaporized refrigerant flows through pipe 231, refrigerant pipe 80*x* and pipes 220 and 223 so as to be returned to suction side 201*b* of compressor 201. Thereby, target space 60 (FIG. 1) in which indoor units 40*a* and 40*b* are disposed is cooled.

In other words, in the cooling operation state, a refrigerant circulation path is formed in the direction in which the refrigerant discharged from compressor 201 passes through outdoor heat exchanger 203 and subsequently passes through indoor heat exchanger 207.

On the other hand, in state 2 (heating operation state), the refrigerant circulation path is formed in the direction indicated by dotted line arrows in FIG. 2. Specifically, the refrigerant that has been changed into high-temperature, high-pressure vapor by compressor 201 flows from pipes 224 and 220 through refrigerant pipe 80*x* so as to be delivered to indoor unit 40. In indoor unit 40, the refrigerant in a vapor state is condensed (liquefied) as a result of heat radiation in indoor heat exchanger 207 when the refrigerant flows through pipe 231 and passes through indoor heat exchanger 207. The condensed refrigerant flows through indoor expansion valve 209 and pipe 232 and passes through refrigerant pipe 80*y* so as to be delivered to outdoor unit 20.

In outdoor unit 20, the refrigerant is evaporated (vaporized) as a result of heat absorption in outdoor heat exchanger 203 when the refrigerant flows through pipe 221, outdoor expansion valve 206 and high-pressure receiver 204 and then passes through outdoor heat exchanger 203. The vaporized refrigerant flows through pipes 222 and 223 so as to be returned to suction side 201*b* of compressor 201. Thereby, target space 60 (FIG. 1) in which indoor units 40*a* and 40*b* are disposed is heated.

In each of state 1 (cooling operation state) and state 2 (heating operation state), outdoor expansion valve 206 is provided in a path that connects outdoor heat exchanger 203 and indoor heat exchanger 207 without passing through compressor 201 in the refrigerant circulation path including compressor 201, outdoor heat exchanger 203, indoor heat exchanger 207, and refrigerant pipes 80*x* and 80*y*. Thus, outdoor unit controller 30 controls outdoor expansion valve 206 to be fully closed, so that the "first interruption mechanism" can be formed. Alternatively, a valve (representatively, an on-off valve) for forming the "first interruption mechanism" can also be disposed on pipe 221 or refrigerant pipe 80*y*. In this way, the "first interruption mechanism" has a function of interrupting the flow of the refrigerant in a liquid state on the refrigerant circulation path.

The following is an explanation about control performed upon detection of a leakage of refrigerant by refrigerant leakage sensor 70 in the refrigeration cycle apparatus according to the first embodiment.

Figure 3:
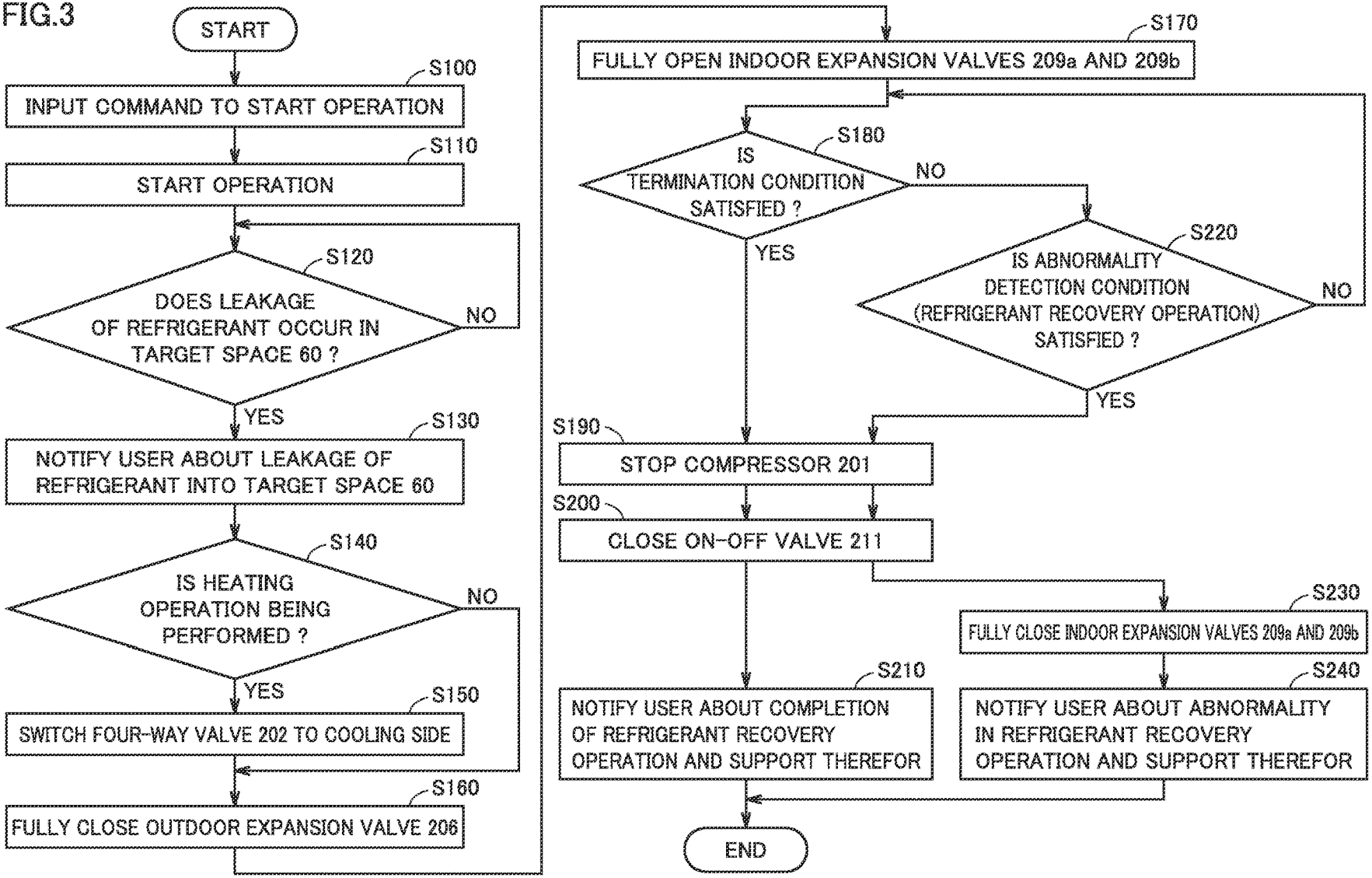
FIG. 3 is a flowchart illustrating a control process in an operation of the refrigeration cycle apparatus.

FIG. 3 is a flowchart illustrating a control process in the operation of the refrigeration cycle apparatus. The control process shown in FIG. 3 can be cooperatively performed by air conditioning system controller 10, outdoor unit controller 30, and indoor unit controller 50, for example. Accordingly, each of the steps shown in FIG. 3 will be described below as being performed by comprehensive controller 101.

Referring to FIG. 3, when a controller 101 receives a command to start the operation of the air conditioning system in step S100, controller 101 starts the air conditioning operation by the refrigeration cycle apparatus shown in FIG. 2 in step S110. When an instruction to perform a cooling operation is given, compressor 201 is operated in the state where controller 101 controls four-way valve 202 to bring about state 1, thereby forming a refrigerant circulation path. In contrast, when an instruction to perform a heating operation is given, compressor 201 is operated in the state where controller 101 controls four-way valve 202 to bring about state 2, thereby forming a refrigerant circulation path. The operation of each element in outdoor unit 20 and indoor unit 40 is controlled such that the operation commands such as a setting temperature are satisfied.

Based on the output from refrigerant leakage sensor 70, controller 101 monitors whether refrigerant leaks or not in target space 60 during the operation of the air conditioning system. When refrigerant leakage sensor 70 does not output a detection signal about a leakage of refrigerant, it is determined as NO in step S120. Then, the air conditioning operation according to an operation command is continued.

When refrigerant leakage sensor 70 outputs a detection signal, it is determined as YES in step S120, and controller 101 starts the process subsequent to step S130.

In step S130, using information output unit 105, controller 101 notifies the user that a leakage of refrigerant occurs in target space 60 in which refrigerant leakage sensor 70 is disposed. In this case, it is preferable that information output unit 105 that outputs a message in at least one of a visual manner and an auditory manner includes information output units 45 in indoor units 40*a* and 40*b*.

Furthermore, in step S140, the controller determines whether the refrigeration cycle apparatus is performing the heating operation or not. When the refrigeration cycle apparatus is performing the heating operation (determined as YES in S140), the controller switches four-way valve 202 to bring about state 1 (the cooling operation state) in step S150. On the other hand, when the refrigeration cycle apparatus is performing the cooling operation (determined as NO in step S140), four-way valve 202 is maintained in state 1 (the cooling operation state). Thereby, when a leakage of refrigerant is detected, a refrigerant circulation path in the cooling operation is formed, that is, a refrigerant circulation path is formed in the direction in which the refrigerant discharged from compressor 201 passes through outdoor heat exchanger 203 and subsequently passes through indoor heat exchanger 207.

In the state where the refrigerant circulation path in the cooling operation is formed, controller 101 controls outdoor expansion valve 206 to be fully closed in step S160. When compressor 201 is continuously operated in the state where outdoor expansion valve 206 interrupts the path through which the refrigerant in a liquid state is delivered to indoor unit 40, the refrigerant recovery operation by the so-called pump down operation is performed. In step S170, controller 101 controls indoor expansion valve 209 to be fully opened in the refrigerant recovery operation.

Again referring to FIG. 2, in the refrigerant recovery operation, the refrigerant vaporized in indoor heat exchanger 207 is suctioned by compressor 201 from indoor unit 40. Furthermore, the refrigerant in the high-temperature and high-pressure state discharged from compressor 201 is delivered to outdoor heat exchanger 203 and condensed therein. Since the path to indoor unit 40 is interrupted, the condensed refrigerant is accumulated in a liquid state inside outdoor heat exchanger 203 and in high-pressure receiver 204. Thereby, the refrigerant recovery operation for recovering refrigerant in outdoor unit 20 can be implemented.

In the refrigerant recovery operation, the amount of refrigerant in a liquid state to be recovered in outdoor unit 20 can be increased by disposing high-pressure receiver 204. In other words, high-pressure receiver 204 corresponds to one example of an "accumulation mechanism". In addition, without providing high-pressure receiver 204 in the configuration in FIG. 2, refrigerant can be stored mainly by outdoor heat exchanger 203.

In the refrigerant recovery operation, it is preferable to promote evaporation (vaporization) in indoor heat exchanger 207 in order to increase the amount of refrigerant to be recovered. Thus, it is preferable that indoor expansion valves 209*a* and 209*b* are fully opened in step S170 while indoor fans 208*a* and 208*b* are operated with maximum output.

Again referring to FIG. 3, during the refrigerant recovery operation, controller 101 determines in step S180 whether the termination condition for a predetermined state amount has been satisfied or not.

In the refrigerant recovery operation, as recovery of refrigerant progresses, the pressure on the low-pressure side of compressor 201, that is, low-pressure detection value Pl by pressure sensor 210 in FIG. 1, decreases.

Figures 4, 5:
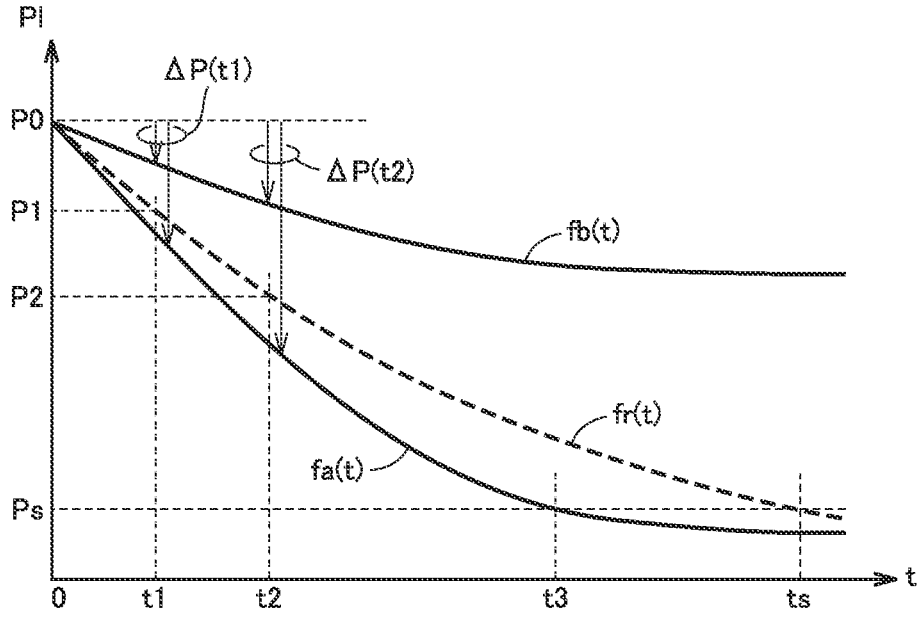
FIG. 4 is a conceptual diagram illustrating an example of a behavior of a low-pressure detection value in a refrigerant recovery operation.
FIG. 5 is a conceptual diagram illustrating variable setting of a reference time period and a reference change characteristic about a change in the low-pressure detection value in the refrigerant recovery operation.

FIG. 4 is a conceptual diagram illustrating an example of a behavior of low-pressure detection value Pl in the refrigerant recovery operation. In FIG. 4, the horizontal axis shows an elapsed time t from the timing at which the refrigerant recovery operation (the pump down operation) is started while the vertical axis shows low-pressure detection value Pl at each point of time.

Referring to FIG. 4, as a behavior of low-pressure detection value Pl with respect to elapsed time t, a pressure change characteristic fa(t) in a normal state and a pressure change characteristic fb(t) in an abnormal state are shown.

Each of pressure change characteristics fa(t) and fb(t) decreases over time from a pressure value P0 at the start of the refrigerant recovery operation (t=0). However, when an abnormality occurs due to failures or the like in compressor 201, outdoor fan 205, outdoor expansion valve 206, or pressure sensor 210, the change (decrease) in low-pressure detection value Pl is reduced as compared with pressure change characteristic fa(t) in a normal state as shown by pressure change characteristic fb(t).

According to pressure change characteristic fa(t) in a normal state, low-pressure detection value Pl decreases eventually to a final pressure (negative pressure) that is lower than atmospheric pressure. On the other hand, according to pressure change characteristic fb(t) in an abnormal state, low-pressure detection value Pl stops to decrease in a region equal to atmospheric pressure or in a region higher than atmospheric pressure. Thus, when a reference value Ps is set to be greater than the above-mentioned final pressure in a normal state, the condition at the point of time of t=ts shows that Pl<Ps in a normal state, whereas Pl>Ps in an abnormal state. Thus, low-pressure detection value Pl does not decrease below reference value Ps.

Accordingly, the termination condition for the refrigerant recovery operation in step S180 in FIG. 3 can be defined as being satisfied when low-pressure detection value Pl decreases to predetermined reference value Ps. In other words, the termination condition can be set assuming that low-pressure detection value Pl is defined as a "state amount".

Furthermore, in a normal state, low-pressure detection value Pl decreases to reference value Ps at the point of time of t=t3. In this case, the time length until t3 or the time length having a margin until t3 is set as a reference time period ts. Thereby, when low-pressure detection value Pl does not decrease to reference value Ps (hereinafter also referred to as "upon occurrence of timeout") at the point of t=ts (in other words, even when reference time period ts has elapsed), an abnormality in the refrigerant recovery operation can be detected. In other words, reference time period ts corresponds to the "first reference time period" or the "second reference time period".

Alternatively, as indicated by a broken line in FIG. 4, reference change characteristic fr(t) can be set in advance, for example, between pressure change characteristics fa(t) and fb(t). Reference change characteristic fr(t) corresponds to the collection of reference pressure values at each elapsed time t from the start of the refrigerant recovery operation. For example, on reference change characteristic fr(t), Pl=P1 at the point of time of t=t1 while Pl=P2 at the point of time of t=t2. Reference change characteristic fr(t) is set in a time period (t<ts) until reference time period ts has elapsed.

Thus, by comparing low-pressure detection value Pl with the reference pressure value at each elapsed time, an abnormality in the refrigerant recovery operation can be detected before a lapse of reference time period ts. For example, in the case where Pl>P1 at the point of time of t=t1 or in the case where Pl>P2 at the point of time of t=t2, an abnormality in the refrigerant recovery operation can be detected. In other words, an optional elapsed time (one or more) before a lapse of reference time period ts is set as the "third or predetermined reference time period". In this case, when low-pressure detection value Pl (that is, the "state amount") in the third or predetermined reference time period is greater than the reference pressure value (that is, the "reference state amount"), an abnormality in the refrigerant recovery operation can be detected.

In addition, reference change characteristic fr(t) can be defined not by the reference pressure value showing the pressure value itself but by the reference value about the degree of pressure change (degree of decrease) ΔP(t) from the start of the refrigerant recovery operation (which will be hereinafter referred to as the degree of reference pressure decrease). Degree of pressure decrease ΔP(t) at each point of time can be defined by the amount of pressure change (decrease) or the rate of pressure change (decrease) from an initial value P0 of low-pressure detection value Pl.

Reference change characteristic fr(t) corresponds to the collection of the degrees of reference pressure decrease at each elapsed time t from the start of the refrigerant recovery operation. While focusing attention on the fact that the degree of change (degree of decrease) ΔP of the pressure detection value is smaller in an abnormal refrigerant recovery operation than in a normal refrigerant recovery operation, an abnormality in the refrigerant recovery operation can be detected before a lapse of reference time period ts. In other words, also when the degree of pressure decrease ΔP(t) as the amount of decrease or as the rate of decrease of low-pressure detection value Pl with respect to initial value P0 is smaller than the degree of reference pressure decrease, an abnormality in the refrigerant recovery operation can be detected.

Alternatively, the reference change amount of low-pressure detection value Pl per unit time is set. Thereby, when the change amount of low-pressure detection value Pl per unit time is smaller than the reference change amount, an abnormality in the refrigerant recovery operation can also be detected. For example, the reference change amount can be set in accordance with reference change characteristic fr(t).

Again referring to FIG. 3, when low-pressure detection value Pl decreases to reference value Ps during the refrigerant recovery operation, controller 101 determines that the predetermined termination condition for low-pressure detection value Pl as the "state amount" has been satisfied (determined as YES in S180), it ends the refrigerant recovery operation. In other words, the termination condition can be set by using low-pressure detection value Pl as a predetermined "state amount".

Specifically, in step S190, controller 101 stops compressor 201 to end the refrigerant recovery operation. Then in step S200, controller 101 closes on-off valve 211. Thereby, the refrigerant (in a liquid state) recovered in outdoor unit 20 can be prevented from flowing back to indoor unit 40. In other words, on-off valve 211 corresponds to one example of the "second interruption mechanism".

Further in step S210, controller 101 notifies a user about completion (normal termination) of the refrigerant recovery operation and support therefor. Specifically, information output unit 105 outputs a message to a user.

When the termination condition is not satisfied during the refrigerant recovery operation (determined as NO in S180), controller 101 determines in step S220 whether the abnormality detection condition for the refrigerant recovery operation has been satisfied or not. For example, upon occurrence of timeout as described above or upon detection that the degree of change ΔP with time of the pressure detection value as the "state amount" is smaller than the degree of change in accordance with reference change characteristic fr(t), the abnormality detection condition for the refrigerant recovery operation is satisfied, and thereby, it is determinate as YES in S220. In other words, an abnormality in the refrigerant recovery operation can be detected based on the behavior of low-pressure detection value Pl as the "state amount", which appears until the termination condition is satisfied. On the other hand, the refrigerant recovery operation is continued while it is determined as NO both in steps S180 and S220.

When an abnormality in the refrigerant recovery operation is detected (determined as YES in S220), controller 101 stops compressor 201 to end the refrigerant recovery operation in the above-mentioned S190, and closes on-off valve 211 in the above-mentioned step S200.

When the refrigerant recovery operation is ended as a result of detection of an abnormality, controller 101 causes the process to proceed to step S230, in which indoor expansion valves 209*a* and 209*b* are fully closed. Thereby, even when unrecovered refrigerant remains on the side of indoor unit 40, remaining refrigerant can be prevented from leaking out from indoor heat exchanger 207.

In step S240, controller 101 notifies the user about occurrence of an abnormality in the refrigerant recovery operation and support therefor. For example, in step S240, information output unit 105 can output: a message for notifying the user that "refrigerant may not have been appropriately recovered"; and a message for urging the user to "ventilate a room and make contact with a service company".

In this way, according to the refrigeration cycle apparatus in the first embodiment, when the abnormality detection condition related to the behavior of the low-pressure detection value as the "state amount" is satisfied due to a failure and the like in compressor 201, outdoor fan 205, outdoor expansion valve 206, or pressure sensor 210 during the refrigerant recovery operation automatically started upon detection of a leakage of refrigerant, an abnormality in the refrigerant recovery operation can be detected. Then, upon detection of an abnormality, the refrigerant recovery operation is ended, and information output unit 105 outputs a message about occurrence of an abnormality and support therefor in at least one of a visual manner and an auditory manner. Thereby, appropriate user guidance can be implemented.

As shown in FIG. 5, reference time period ts and reference change characteristic fr(t) about a change in low-pressure detection value Pl can also be variably set.

FIG. 5 is a conceptual diagram for illustrating variable setting of reference time period ts and reference change characteristic fr(t) in accordance with the temperature condition and the amount of sealed refrigerant.

Referring to FIG. 5, a plurality of stages (A, B, C, . . . ) can be set as a temperature condition based on atmospheric temperatures Tot, Tra, and Trb detected by temperature sensors 214, 215*a*, and 215*b*, respectively. Similarly, a plurality of stages (for example, M1, M2) can be set in accordance with the amount of sealed refrigerant in the refrigeration cycle apparatus.

For reference change characteristic fr(t) and reference time period ts of low-pressure detection value Pl, different characteristics and reference values can be set for each combination of the stage of the temperature condition and the stage of the amount of sealed refrigerant.

In the example in FIG. 5, when the amount of sealed refrigerant is in a stage M1, reference change characteristic fr(t) can be set as different characteristics f11(*t*), f12(*t*), f13(*t*), . . . so as to correspond to stages A, B, and C, . . . , respectively, of the temperature condition. Similarly, reference time period ts can be set at different values ts11, ts12, ts13, . . . so as to correspond to stages A, B, and C, . . . , respectively, of the temperature condition.

Similarly, when the amount of sealed refrigerant is in a stage M2 (smaller in amount than stage M1), reference change characteristic fr(t) can be set as different characteristics f21(*t*), f22(*t*), f23(*t*), . . . so as to correspond to stages A, B, and C, . . . , respectively, of the temperature condition. Similarly, reference time period ts can be set at different values ts21, ts22, ts23, . . . so as to correspond to stages A, B, C, . . . , respectively, of the temperature condition.

Figure 6:
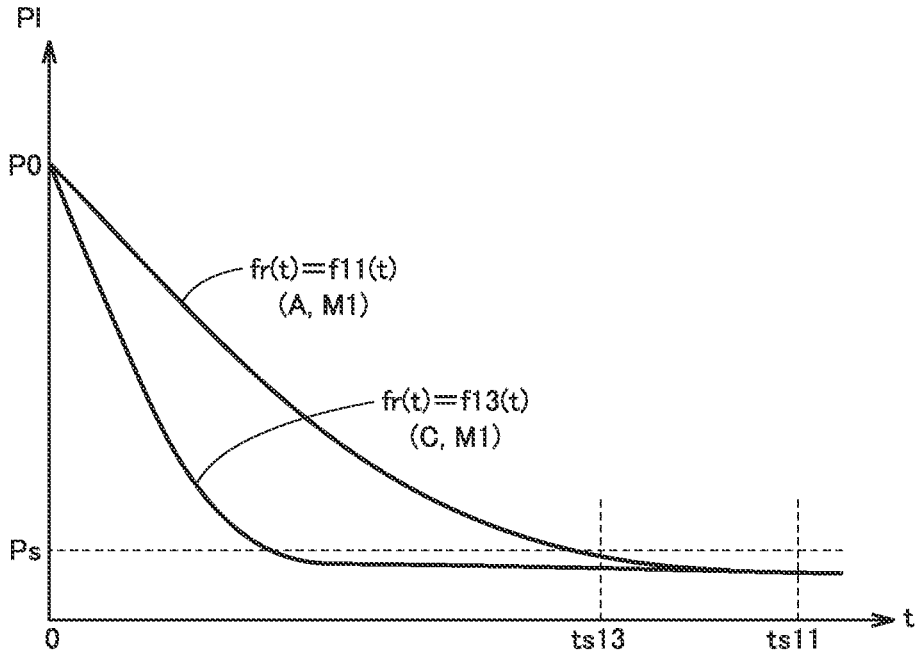
FIG. 6 is a conceptual diagram illustrating variable setting for a temperature condition with respect to the reference change characteristic and the reference time period about a change in the low-pressure detection value.

FIG. 6 is a conceptual diagram illustrating variable setting for the temperature condition with respect to reference change characteristic fr(t) and reference time period ts of low-pressure detection value Pl.

Referring to FIG. 6, when the amount of sealed refrigerant is in stage M1 and when the temperature condition is in stage A (at a high temperature), setting is provided such that fr(t)=f11(*t*) and ts=ts11. In contrast, when the amount of sealed refrigerant is in the same stage M1 and when the temperature condition is in stage C (lower in temperature than stage A), setting is provided such that fr(t)=f13(*t*) and ts=ts13.

A change in low-pressure detection value Pl during the refrigerant recovery operation becomes gentler at a high temperature than at a low temperature. Upon reflection of such a phenomenon, reference time period ts (ts11) at a high temperature (in stage A) is set to be longer than reference time period ts (ts13) at a low temperature (in stage C). Similarly, reference change characteristic fr(t) (f11(*t*)) at a high temperature (in stage A) is set to be smaller in degree of change ΔP(t) with time than reference change characteristic fr(t) (f13(*t*)) at a low temperature (in stage C).

In other words, depending on the temperature condition, the variable setting can be performed such that, as the temperature is lower, reference time period ts is shorter and reference change characteristic fr(t) is greater in degree of change ΔP(t).

Figure 7:
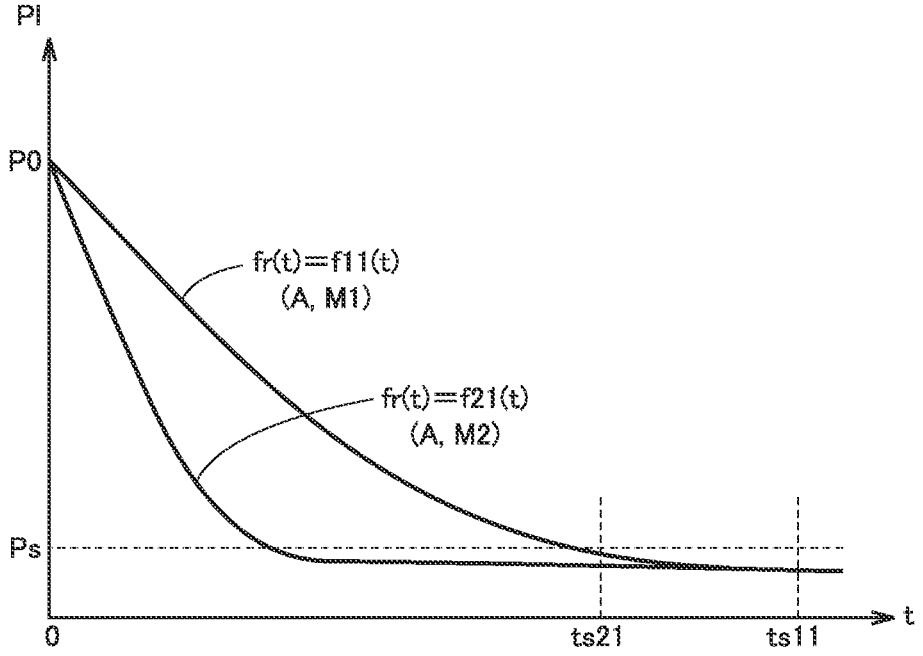
FIG. 7 is a conceptual diagram illustrating variable setting for an amount of sealed refrigerant with respect to the reference change characteristic and the reference time period about a change in the low-pressure detection value.

FIG. 7 illustrates variable setting for the amount of sealed refrigerant with respect to reference change characteristic fr(t) and reference time period ts of low-pressure detection value Pl.

Referring to FIG. 7, when the amount of sealed refrigerant is in stage M1 and the temperature condition is in stage A, setting is provided such that fr(t)=f11(*t*) and ts=ts11. In contrast, when the temperature condition is in the same stage A and the amount of sealed refrigerant is in stage M2 (smaller in amount than M1), setting is provided such that fr(t)=f21(*t*) and ts=ts21.

A change in low-pressure detection value Pl during the refrigerant recovery operation is gentler in the state of a larger amount of sealed refrigerant than in the state of a smaller amount of sealed refrigerant. Upon reflection of such a phenomenon, reference time period ts (ts11) in the state of a larger amount of sealed refrigerant (in stage M1) is set to be longer than reference time period ts (ts21) in the state of a smaller amount of sealed refrigerant (in stage M2). Similarly, reference change characteristic fr(t) (f11(*t*)) in the state of a larger amount of sealed refrigerant (in stage M1) is set to be smaller in degree of pressure change ΔP(t) with time than reference change characteristic fr(t) (f11(*t*)) in the state of a smaller amount of sealed refrigerant (in stage M2).

In other words, depending on the amount of sealed refrigerant, the variable setting can be performed such that, as the amount of refrigerant is smaller, reference time period ts is shorter and reference change characteristic fr(t) is larger in degree of change ΔP(t).

In this way, in the refrigerant recovery operation of the refrigeration cycle apparatus according to the first embodiment, the abnormality detection condition can be adjusted in accordance with the temperature condition and the amount of sealed refrigerant, so that erroneous detection of an abnormality can be prevented.

As to the temperature condition, the stage can be selected based on the temperature detection values by temperature sensors 214 and 215 shown in FIG. 1 while one of the plurality of stages can be selected using the calendar function of controller 101 from among the temperatures predicted based on date and month (season) or the combination of date and month (season) and time.

Modification of First Embodiment

The modification of the first embodiment will be described below with regard to an example in which the "state amount" used for the termination condition and the abnormality detection condition for the refrigerant recovery operation is set to be different from low-pressure detection value Pl (pressure sensor 210).

Figure 8:
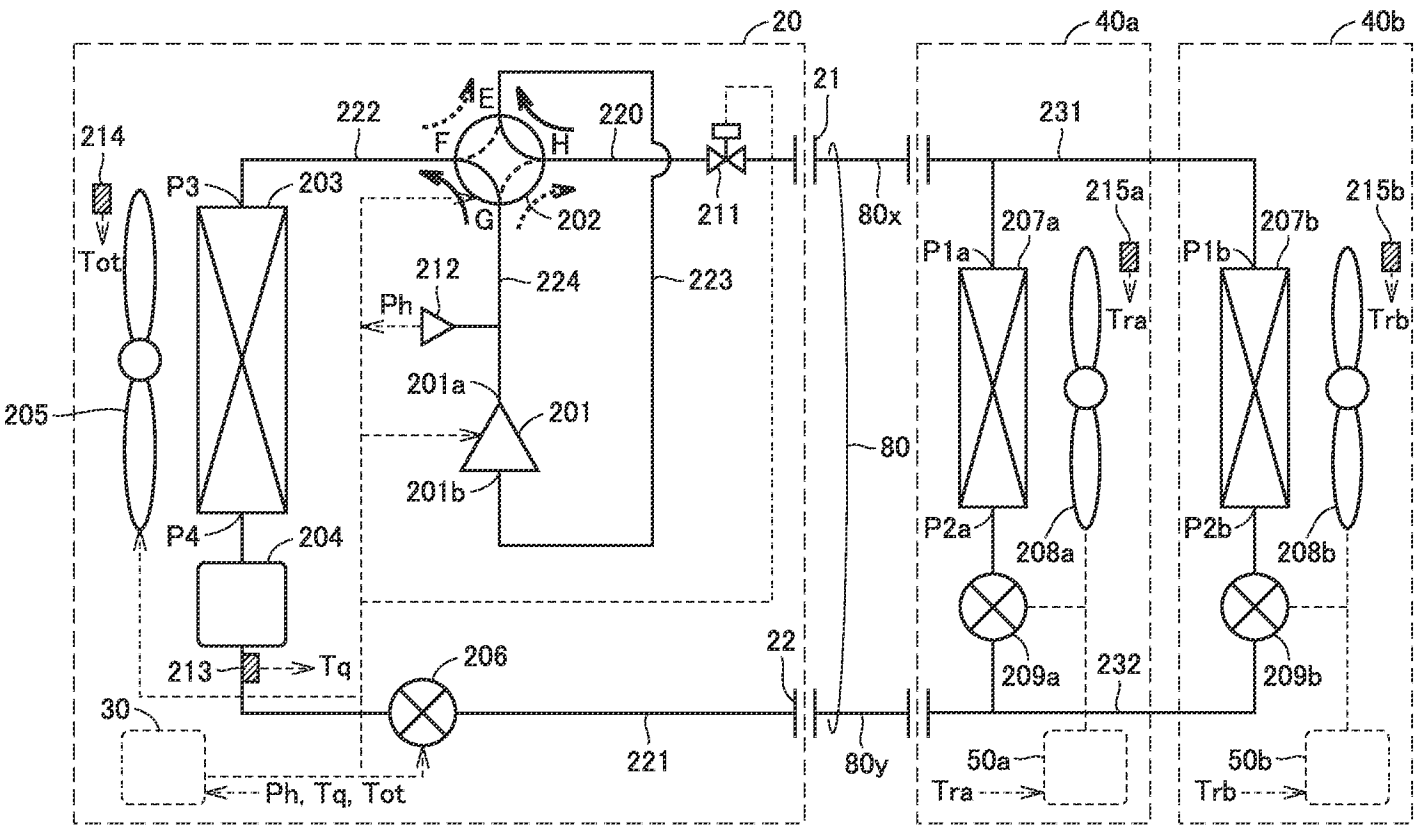
FIG. 8 is a block diagram illustrating the configuration of a refrigerant circuit in a refrigeration cycle apparatus according to a modification of the first embodiment.

FIG. 8 is a block diagram illustrating the configuration of a refrigerant circuit in a refrigeration cycle apparatus according to a modification of the first embodiment.

When comparing FIG. 8 with FIG. 1, arrangement of the sensor in the refrigerant circuit is different in the modification of the first embodiment. Specifically, temperature sensor 213 is disposed downstream (in the cooling operation state) of outdoor heat exchanger 203 and high-pressure receiver 204 while pressure sensor 212 is disposed on the discharge side (the high-pressure side) of compressor 201. Pressure sensor 212 detects a high-pressure detection value Ph, which is then input into outdoor unit controller 30. Similarly, temperature sensor 213 detects a refrigerant temperature Tq of the refrigerant in a liquid state, which is then input into outdoor unit controller 30. The configuration of the refrigerant circuit according to the modification of the first embodiment is the same as that of the first embodiment (FIG. 2) except for arrangement of the sensor as described above.

Based on high-pressure detection value Ph and refrigerant temperature Tq, outdoor unit controller 30 calculates the degree of supercooling (SC) of the accumulated refrigerant (in a liquid state). The degree of supercooling is defined by the value that is obtained by subtracting refrigerant temperature Tq detected by temperature sensor 213 from the value that is obtained by converting high-pressure detection value Ph of pressure sensor 212 into a saturation temperature of the refrigerant.

In the refrigerant recovery operation, as the recovery of refrigerant progresses, the amount of refrigerant (in a liquid state) accumulated in outdoor unit 20 (outdoor heat exchanger 203 and high-pressure receiver 204) increases, so that degree of supercooling SC rises accordingly. Thus, in the modification of the first embodiment, the termination condition and the abnormality detection condition for the refrigerant recovery operation are set assuming that not low-pressure detection value Pl of compressor 201 but the degree of supercooling (SC) on the output side of outdoor heat exchanger 203 is defined as the "state amount".

Figure 9:
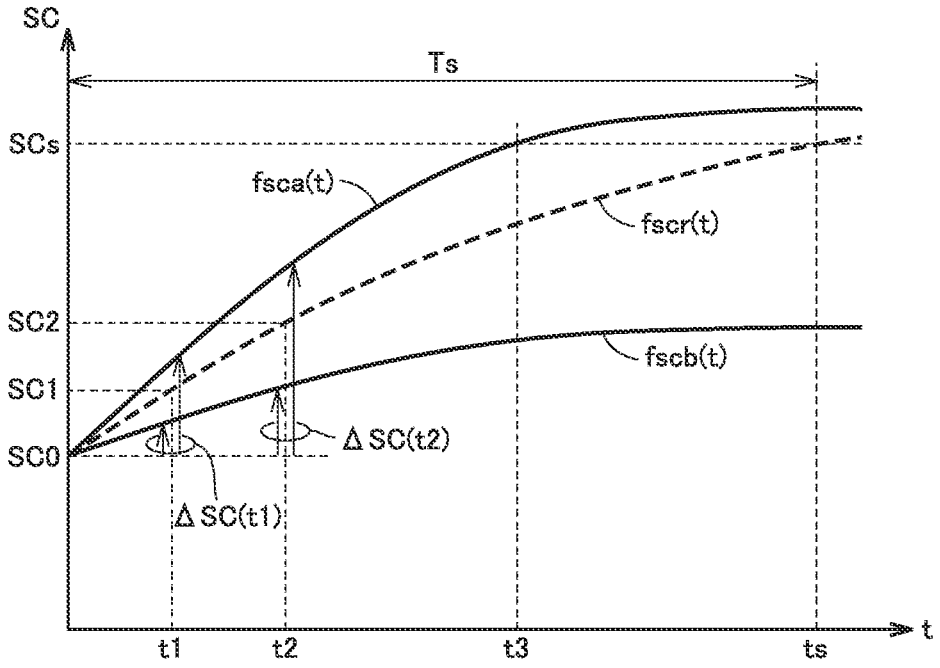
FIG. 9 is a conceptual diagram illustrating an example of a behavior of the degree of supercooling in the refrigerant recovery operation.

FIG. 9 is a conceptual diagram for illustrating a behavior of a change in degree of supercooling SC in the refrigerant recovery operation. In FIG. 9, the horizontal axis shows elapsed time t from the timing at which the refrigerant recovery operation (the pump down operation) is started while the vertical axis shows degree of supercooling SC at each point of time.

Referring to FIG. 9, according to SC change characteristic fsca(t) in a normal state, degree of supercooling SC eventually rises to a fixed saturation value. On the other hand, according to SC change characteristic fsca(t) in an abnormal state, degree of supercooling SC is saturated in a region lower than that in a normal state. Thus, when reference value SCs lower than the SC saturation value in a normal state is set, the condition at the point of time of t=ts shows that SC>SCs in a normal state, whereas SC<SCs in an abnormal state. Thus, degree of supercooling SC does not rise above reference value SCs.

Therefore, the termination condition for the refrigerant recovery operation in step S180 in FIG. 3 can be defined as being satisfied when degree of supercooling SC, which is defined in place of low-pressure detection value Pl as the "state amount", rises to predetermined reference value SCs.

Also, in a normal state, degree of supercooling SC rises to reference value SCs at the point of time of t=t3. Thus, the time length until t3 or the time length having a margin until t3 is set as reference time period ts. Thereby, when degree of supercooling SC does not rise to reference value SCs at the point of time of t=ts, an abnormality in the refrigerant recovery operation resulting from occurrence of timeout can be detected.

Alternatively, while focusing attention on the fact that degree of change (degree of increase) ΔSC of degree of supercooling SC from the start of the refrigerant recovery operation becomes smaller in an abnormal state than in a normal state, an abnormality in the refrigerant recovery operation can be detected before a lapse of reference time period ts. Degree of increase ΔSC(t) at each point of time can be defined by the amount of change (increase) or the rate of increase (rise) about degree of supercooling SC from initial value SC0 at the start of the refrigerant recovery operation.

As indicated by a broken line in FIG. 9, reference change characteristic fscr(t) can be set in advance, for example, between SC change characteristics fsca(t) and fscb(t). On reference change characteristic fscr(t), SC=SC1 at the point of time of t=t1 while SC=SC2 at the point of time of t=t2. Accordingly, in the case where SC<SC1 at the point of time of t=t1, degree of change ΔSC(t) with time of degree of supercooling SC is smaller than the degree of change in accordance with reference change characteristic fscr(t). Thus, an abnormality in the refrigerant recovery operation can be detected. Similarly, also in the case where SC<SC2 at the point of time of t=t2, an abnormality in the refrigerant recovery operation can be detected.

In other words, it can be determined that the termination condition for the refrigerant recovery operation in step S180 in FIG. 3 is satisfied when degree of supercooling SC as the "state amount" rises to reference value SCs. Furthermore, it can be determined that the abnormality detection condition for the refrigerant recovery operation in step S220 in FIG. 3 has been satisfied upon occurrence of timeout about degree of supercooling SC, or upon detection that degree of change ΔSC(t) with time of the degree of supercooling is smaller than the degree of change in accordance with reference change characteristic fscr(t). For example, when degree of supercooling SC (that is, the "state amount") in an optional elapsed time (that is, corresponding to the "third or predetermined reference time period") before a lapse of reference time period ts is smaller than the reference value (that is, the "reference state amount") of the degree of supercooling in accordance with reference change characteristic fscr(t), an abnormality in the refrigerant recovery operation can be detected. Alternatively, by setting the reference change amount of degree of supercooling SC per reference unit time, an abnormality in the refrigerant recovery operation can also be detected when the change amount of degree of supercooling SC per unit time is smaller than the reference change amount. The reference change amount can be set in accordance with reference change characteristic fscr(t).

In addition, for the abnormality detection condition on which degree of supercooling SC is defined as the "state amount", reference time period ts and reference change characteristic fscr(t) can be set variably in accordance with the temperature condition and the amount of sealed refrigerant. Specifically, depending on the temperature condition, the variable setting can be performed such that, as the temperature is lower, reference time period ts is shorter and reference change characteristic fr(t) is larger in degree of change ΔP(t). Furthermore, depending on the amount of sealed refrigerant, the variable setting can be performed such that, as the amount of refrigerant is larger, reference time period ts is shorter and reference change characteristic fr(t) is larger in degree of change ΔP(t).

Furthermore, it is understood that, in the refrigerant recovery operation, the refrigerant gas concentration detected by refrigerant leakage sensor 70 decreases as recovery of the refrigerant progresses. Accordingly, in each of the configurations in FIG. 2 and FIG. 8, the termination condition and the abnormality detection condition for the refrigerant recovery operation can be set assuming that the refrigerant gas concentration detected by refrigerant leakage sensor 70 is defined as the "state value". As described above, the refrigerant gas concentration can be indirectly detected also by the oxygen concentration that lowers or rises as the refrigerant gas concentration rises or lowers. Refrigerant leakage sensor 70 is required to be configured to have a function of detecting the refrigerant gas concentration (or the oxygen concentration) in a quantitative value or in stages.

Figure 10:
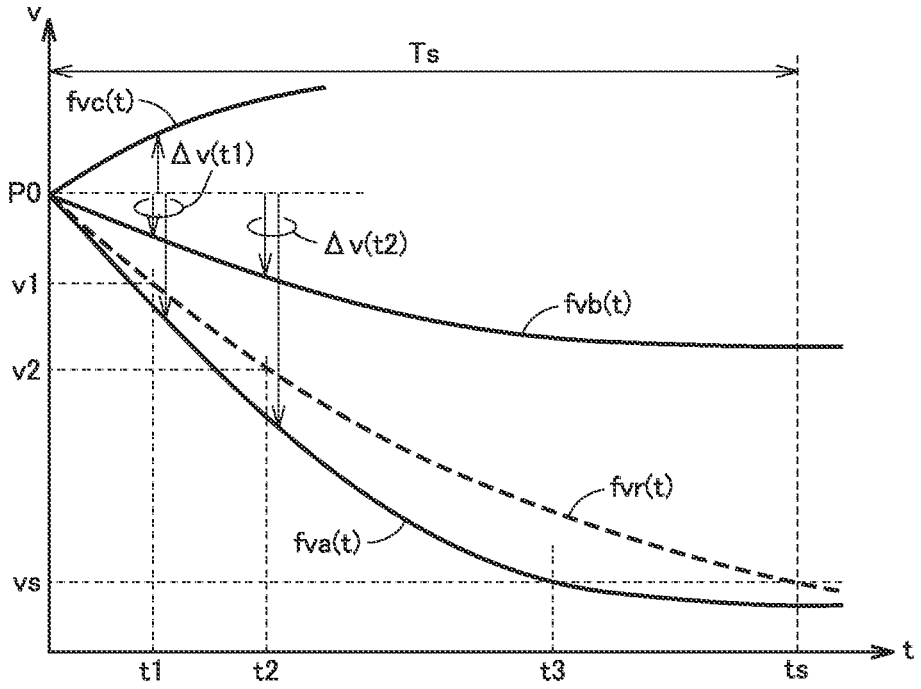
FIG. 10 is a conceptual diagram illustrating an example of a behavior of a refrigerant gas concentration in the refrigerant recovery operation.

FIG. 10 is a conceptual diagram for illustrating a behavior of a change in degree of a refrigerant gas concentration in the refrigerant recovery operation. In FIG. 10, the horizontal axis shows elapsed time t from the timing at which the refrigerant recovery operation (the pump down operation) is started while the vertical axis shows a refrigerant gas concentration v at each point of time.

Referring to FIG. 10, according to refrigerant concentration change characteristic fva(t) in a normal state, refrigerant gas concentration v eventually decreases below a predetermined reference value vs. On the other hand, according to refrigerant concentration change characteristic fvb(t) in an abnormal state, refrigerant gas concentration v does not decrease to reference value vs. Alternatively, as with refrigerant concentration change characteristic fvc(t), refrigerant gas concentration v may rise as refrigerant continuously leaks.

Accordingly, in a normal state, refrigerant gas concentration v decreases to reference value vs at the point of time of t=t3. In contrast, in an abnormal state, refrigerant gas concentration v does not decrease to reference value vs. Thus, the termination condition for the refrigerant recovery operation in step S180 in FIG. 3 can be set to be satisfied when refrigerant gas concentration v, which is defined in place of low-pressure detection value Pl as the "state amount", decreases to predetermined reference value vs.

Furthermore, the time length until t3 during which refrigerant gas concentration v decreases to reference value vs in a normal state or the time length having a margin until t3 is set as reference time period ts. Thereby, when refrigerant gas concentration v does not decrease to reference value vs at the point of time of t=ts, an abnormality in the refrigerant recovery operation resulting from occurrence of timeout can be detected.

Alternatively, while focusing attention on the fact that degree of change (degree of decrease) Δv of refrigerant gas concentration v from the start of the refrigerant recovery operation is smaller in an abnormal state than in a normal state, an abnormality in the refrigerant recovery operation can also be detected before a lapse of reference time period ts. Degree of decrease Δv(t) at each point of time can be defined by the amount of change (decrease) or the rate of increase (decrease) of refrigerant gas concentration v from an initial value v0 at the start of the refrigerant recovery operation.

As indicated by a broken line in FIG. 10, reference change characteristic fvr(t) can be set in advance, for example, between refrigerant concentration change characteristics fva (t) and fvb(t). On reference change characteristic fvr(t), v=v1 at the point of time of t=t1 while v=v2 at the point of time t=t2. Thus, in the case where v>v1 at the point of time of t=t1, degree of change Δv(t) with time of refrigerant gas concentration v is smaller than the degree of change in accordance with reference change characteristic fvr(t). Accordingly, an abnormality in the refrigerant recovery operation can be detected. Similarly, also in the case where v>v2 at the point of time of t=t2, an abnormality in the refrigerant recovery operation can be detected.

In other words, it can be determined that the termination condition for the refrigerant recovery operation in step S180 in FIG. 3 has been satisfied when refrigerant gas concentration v as the "state amount" decreases to reference value vs. Furthermore, it can be determined that the abnormality detection condition for the refrigerant recovery operation in step S220 in FIG. 3 has been satisfied upon occurrence of timeout for refrigerant gas concentration v, or upon detection that degree of change Δv(t) with time of the refrigerant gas concentration is smaller than the degree of change in accordance with reference change characteristic fvr(t). For example, when refrigerant gas concentration v (that is, the "state amount") in an optional elapsed time (that is, corresponding to the "third or predetermined reference time period") before a lapse of reference time period ts is greater than the reference value (that is, the "reference state amount") of the refrigerant gas concentration in accordance with reference change characteristic fvr(t), an abnormality in the refrigerant recovery operation can be detected. Alternatively, by setting the reference change amount of refrigerant gas concentration v per unit time, an abnormality in the refrigerant recovery operation can also be detected when the change amount of refrigerant gas concentration v per unit time is smaller than the reference change amount. The reference change amount can be set in accordance with reference change characteristic fvr(t).

Also for the abnormality detection condition on which refrigerant gas concentration v is defined as the "state amount", reference time period ts and reference change characteristic fscr(t) can be set variably in accordance with the temperature condition and the amount of sealed refrigerant. Specifically, depending on the temperature condition, the variable setting can be performed such that, as the temperature is lower, reference time period ts is shorter and reference change characteristic fr(t) is larger in degree of change ΔP(t). Furthermore, depending on the amount of sealed refrigerant, the variable setting can be performed such that, as the amount of refrigerant is smaller, reference time period ts is shorter and reference change characteristic fr(t) is larger in degree of change ΔP(t).

As having been described in the modification of the first embodiment, in the refrigeration cycle apparatus according to the present embodiment, normal termination of the refrigerant recovery operation and occurrence of an abnormality in the refrigerant recovery operation can be detected in the state where the state amount is selected as appropriate.

Second Embodiment

The second embodiment will be hereinafter described with regard to a modification of the configuration of a refrigerant circuit in a refrigeration cycle apparatus.

Figure 11:
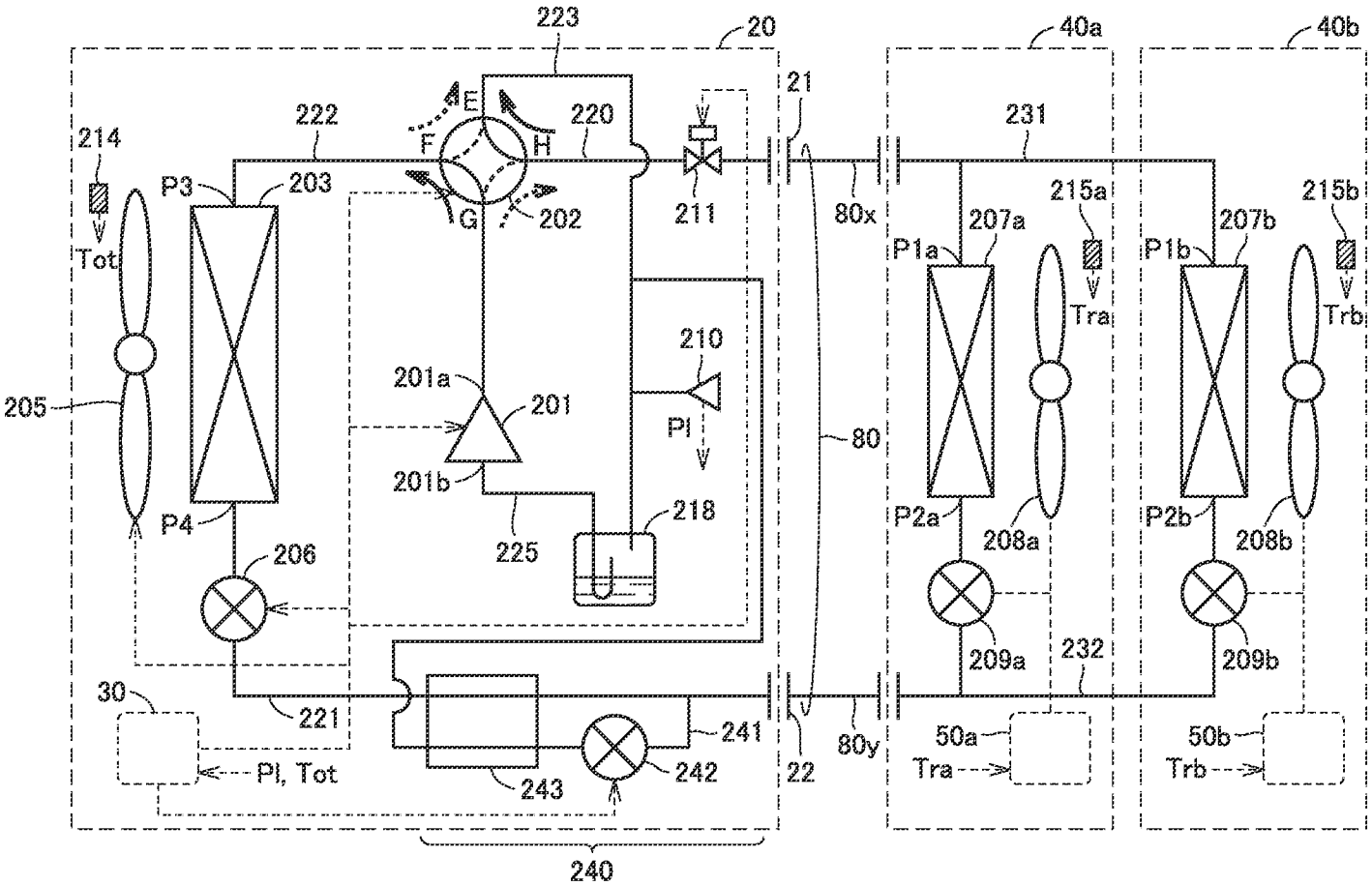
FIG. 11 is a block diagram illustrating the configuration of a refrigerant circuit in a refrigeration cycle apparatus according to the second embodiment.

FIG. 11 is a block diagram illustrating the configuration of a refrigerant circuit in a refrigeration cycle apparatus according to the second embodiment.

When comparing FIG. 11 with FIG. 1, an accumulator 218 is disposed in place of high-pressure receiver 204 in the configuration according to the second embodiment. Accumulator 218 is disposed on suction side 201*b* of compressor 201 and serves to isolate the refrigerant in a liquid state and accumulates the isolated refrigerant therein. Accumulator 218 is connected through a pipe 223 to port E of four-way valve 202 and connected through a pipe 225 to suction side 201*b* of compressor 201. Thereby, in the operation of compressor 201, only the refrigerant in a gaseous state is supplied from accumulator 218 to suction side 201*b* of compressor 201. In the refrigerant recovery operation, the refrigerant in a liquid state can be accumulated in accumulator 218. Thus, accumulator 218 corresponds to one example of an "accumulation mechanism" of the refrigerant. As an "accumulation mechanism", both high-pressure receiver 204 (FIG. 1) and accumulator 218 can be disposed.

Furthermore, in the configuration in FIG. 11 in which accumulator 218 is disposed, a bypass mechanism 240 can be further provided, which extends from pipe 221 through which refrigerant in a liquid state flows. Bypass mechanism 240 includes a bypass pipe 241, an expansion valve 242, and an inside heat exchanger 243.

Bypass pipe 241 is disposed such that the refrigerant having passed through outdoor heat exchanger 203 is routed, during the cooling operation, to a refrigerant inlet of accumulator 218 from the refrigerant path (pipe 221) through which the refrigerant is delivered to indoor unit 40. An expansion valve 242 is provided at some midpoint in bypass pipe 241. An electronic expansion valve (LEV) having a degree of opening that is electronically controlled according to the command from outdoor unit controller 30 is applicable to expansion valve 242.

Inside heat exchanger 243 is configured to perform heat exchange between the refrigerant flowing through bypass pipe 241 and the refrigerant flowing through pipe 221 in the refrigerant circuit. By opening expansion valve 242 (the degree of opening >0), a bypass path for refrigerant is formed so as to extend through inside heat exchanger 243 to accumulator 218. Furthermore, by changing the degree of opening, the amount of refrigerant that passes through the bypass path can be adjusted. On the other hand, by closing expansion valve 242 (the degree of opening=0: fully closed state), the refrigerant bypass path extending through bypass pipe 241 can be interrupted.

During the operation of the refrigeration cycle apparatus, formation of a refrigerant bypass path by bypass mechanism 240 leads to heat exchange in inside heat exchanger 243, so that liquefaction of the refrigerant that flows through pipe 221 can be promoted. Thereby, refrigerant noise can be suppressed while pressure loss can be suppressed.

In the configuration in FIG. 11, the configurations of components other than accumulator 218 and bypass mechanism 240 in the refrigerant circuit are the same as those in FIG. 2, and therefore, the detailed description thereof will not be repeated.

Also in the configuration in which accumulator 218 is disposed, the termination condition and the abnormality detection condition for the refrigerant recovery operation can be set as described in the first embodiment, assuming that low-pressure detection value Pl by pressure sensor 210 disposed in the same manner as in FIG. 1 is defined as the "state amount".

Alternatively, as having been described in the modification of the first embodiment, the termination condition and the abnormality detection condition for the refrigerant recovery operation can also be set assuming that the refrigerant gas concentration detected by refrigerant leakage sensor 70 is defined as the "state amount" or assuming that degree of supercooling SC calculated from the detection values of pressure sensor 212 and temperature sensor 213 that are disposed in the same manner as in FIG. 8 is defined as the "state amount".

Furthermore, in the configuration shown in FIG. 11, when four-way valve 202 is controlled to bring about state 2 (the heating operation state), suction side 201*b* of compressor 201 is to be connected to the indoor unit 40 side through accumulator 218. Accordingly, even when on-off valve 211 is not disposed, four-way valve 202 controlled to bring about state 2 can form an "interruption mechanism" after the end of the refrigerant recovery operation. In other words, arrangement of on-off valve 211 corresponding to the "second interruption mechanism" does not have to be provided. In this case, in step S200 in FIG. 3, four-way valve 202 is controlled to bring about state 2 (heating operation state) in place of closing of on-off valve 211.

Alternatively, also in the configuration in FIG. 1, compressor 201 is configured so as to structurally interrupt the refrigerant path inside compressor 201, which can eliminate the need to dispose on-off valve 211. In this case, the process in step S200 in FIG. 3 is not required.

As having been described above in the second embodiment, the termination condition and the abnormality detection condition for the refrigerant recovery operation that is automatically started upon detection of a leakage of the refrigerant in the refrigeration cycle apparatus according to the first embodiment is applicable without limiting the configuration of the refrigerant circuit to the basic configuration shown in FIG. 2.

Third Embodiment

In the third embodiment, a modification of an air conditioning system will be described.

Figure 12:
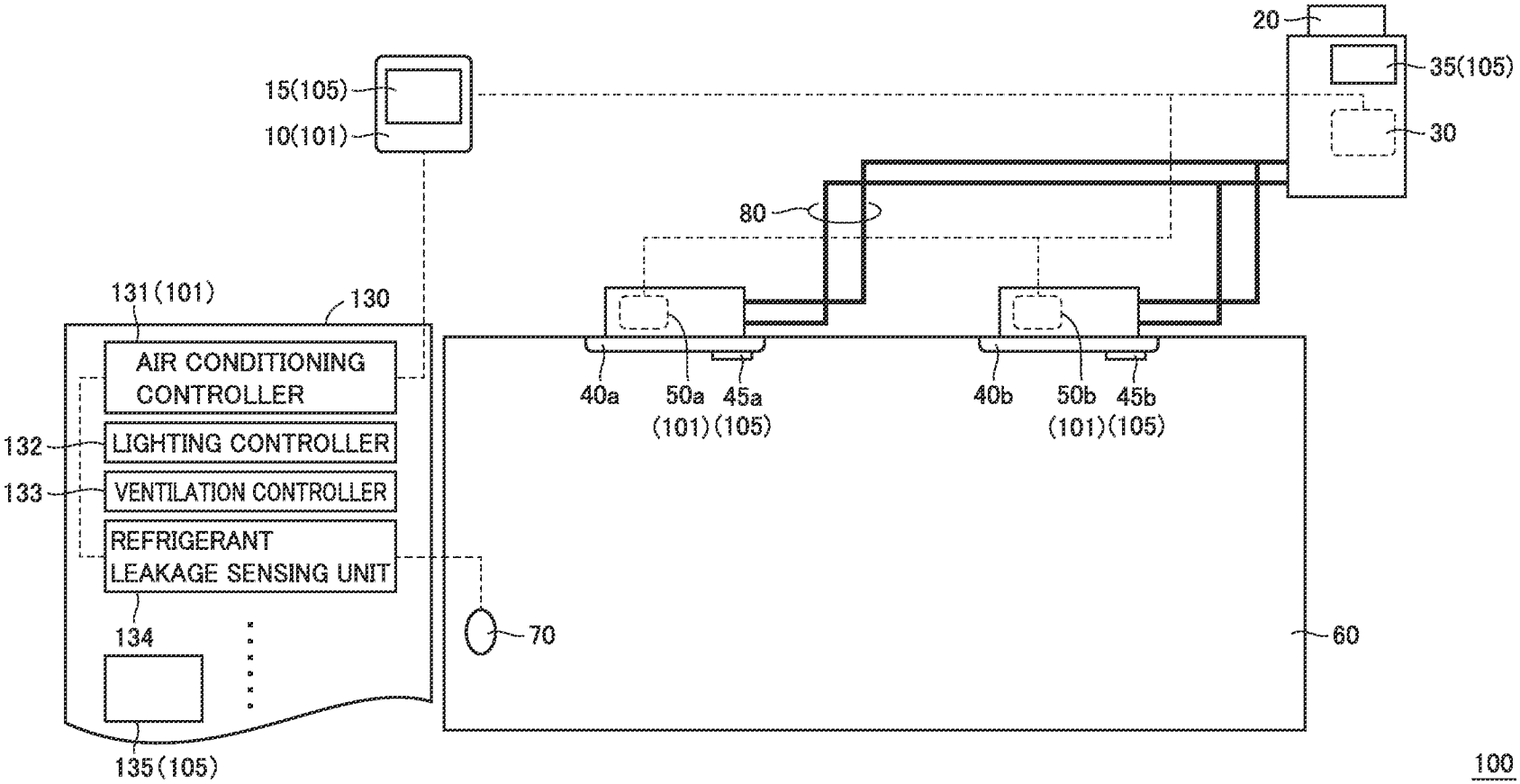
FIG. 12 is a block diagram illustrating the first configuration example of an air conditioning system according to the third embodiment.

FIG. 12 is a block diagram illustrating the first configuration example of an air conditioning system according to the third embodiment.

Referring to FIG. 12, in the first configuration example of the air conditioning system according to the third embodiment, control of the refrigeration cycle apparatus having been described in the first and second embodiments can also be implemented by a part of a general building system controller 130 for a room in a building as a target space 60.

Building system controller 130 includes an air conditioning controller 131, a lighting controller 132 and a ventilation controller 133. According to the command to air conditioning system controller 10, air conditioning controller 131 adjusts the air temperature in target space 60 by the cooling function and the heating function performed by the refrigeration cycle apparatus (FIG. 2 and the like) including outdoor unit 20 and indoor units 40*a* and 40*b*.

According to the instruction from the user, lighting controller 132 controls a lighting device (not shown) disposed in target space 60 to be turned on and off and also controls the intensity of illumination when the lighting device is turned on. According to the instruction from the user, ventilation controller 133 controls the operation of the ventilating device (not shown) disposed in target space 60 to be started and stopped. In addition, each of the functions of air conditioning controller 131, lighting controller 132 and ventilation controller 133 can be implemented as part of the control function implemented by a microcomputer.

Consequently, as part of comprehensive building system control, air conditioning system controller 10 can also control the refrigeration cycle apparatus according to the instruction from air conditioning controller 131. In other words, the refrigerant recovery operation having been described in the first embodiment (including a modification thereof) and the second embodiment can also be performed as part of air conditioning control by building system controller 130. In the configuration example in FIG. 12, air conditioning system controller 10 (a computer), outdoor unit controller 30, indoor unit controller 50, and air conditioning controller 131 can form controller 101 for the refrigeration cycle apparatus.

In this case, it is preferable that information output unit 105 for a user interface that has been described in the first embodiment (including a modification thereof) and the second embodiment is disposed also in building system controller 130.

Alternatively, building system controller 130 can further include a refrigerant leakage sensing unit 134. Refrigerant leakage sensing unit 134 can receive an output signal from refrigerant leakage sensor 70 through radio communication or through a signal line. In this case, refrigerant leakage sensing unit 134 detects a leakage of refrigerant in target space 60. Detection of a leakage of refrigerant is transmitted from refrigerant leakage sensing unit 134 through air conditioning system controller 10 to outdoor unit controller 30 and indoor unit controller 50. Thereby, the refrigerant recovery operation having been described in the first embodiment (including a modification thereof) and the second embodiment can be performed.

Figure 13:
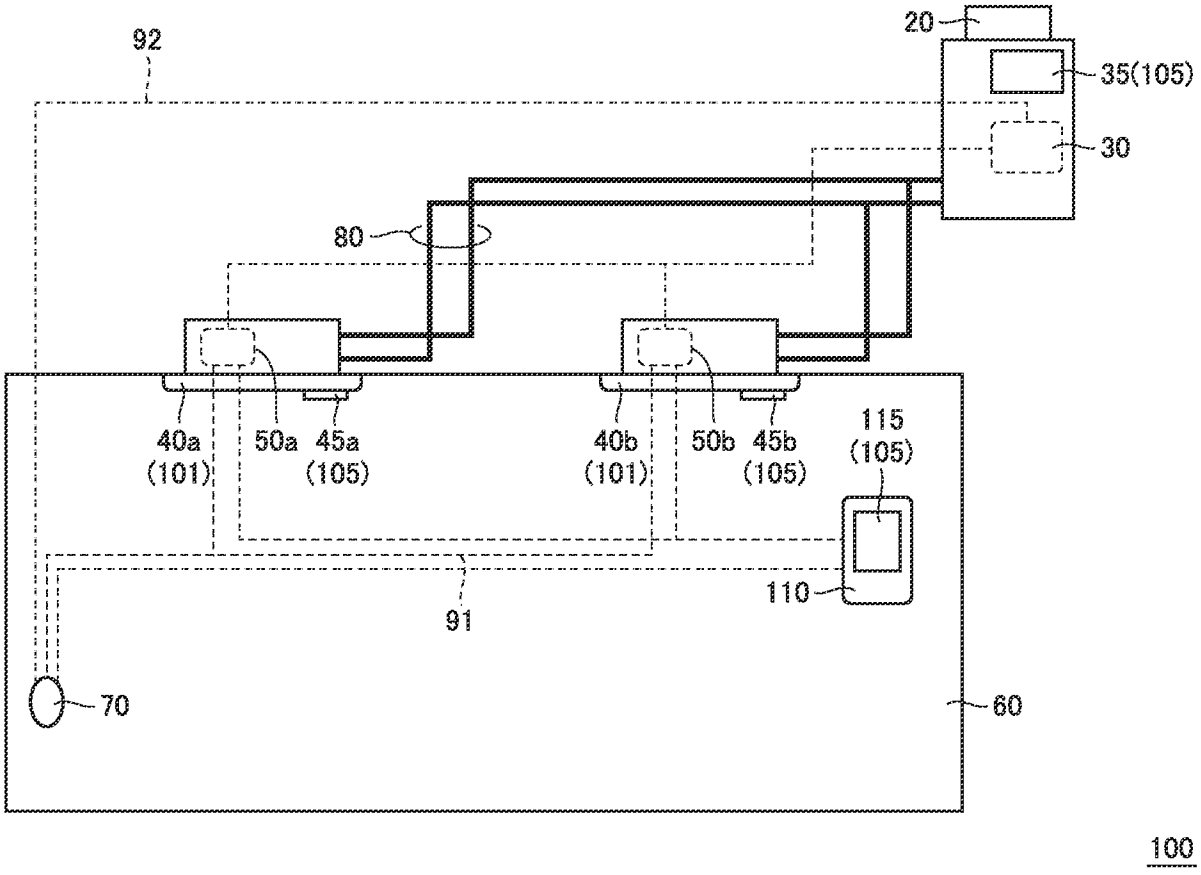
FIG. 13 is a block diagram illustrating the second configuration example of the air conditioning system according to the third embodiment.

FIG. 13 is a block diagram illustrating the second configuration example of the air conditioning system according to the third embodiment.

Referring to FIG. 13, in the first configuration example of the air conditioning system according to the third embodiment, in place of air conditioning system controller 10 in FIG. 1, a remote controller (which will be hereinafter also referred to as an "indoor remote controller") is disposed as a user interface in target space 60.

Indoor remote controller 110 can be provided with a display unit 115 such as a liquid crystal panel and a speaker (not shown). By display unit 115 and the speaker as described above, information output unit 105 for outputting a message in at least one of a visual manner and an auditory manner to a user can be disposed in indoor remote controller 110. In addition, a plurality of indoor remote controllers 110 may be disposed in the same target space 60.

In the configuration example in FIG. 13, controller 101 of the refrigeration cycle apparatus can be formed of a microcomputer (not shown) in indoor remote controller 110, outdoor unit controller 30 and indoor unit controller 50 in place of air conditioning system controller 10. Furthermore, the output signal from refrigerant leakage sensor 70 can be input into indoor remote controller 110. Alternatively, through an electrical connection via a signal line 91 between refrigerant leakage sensor 70 and indoor unit controller 50 (50*a*, 50*b*), the output signal from refrigerant leakage sensor 70 may be transmitted from indoor unit controller 50 to indoor remote controller 110 and outdoor unit controller 30.

Alternatively, through an electrical connection via a signal line 92 between refrigerant leakage sensor 70 and outdoor unit controller 30, the output signal from refrigerant leakage sensor 70 may be transmitted from outdoor unit controller 30 to indoor unit controller 50 (50*a*, 50*b*) and indoor remote controller 110.

In each of the configurations in FIGS. 1, 12 and 13, a plurality of refrigerant leakage sensors 70 may be disposed in one target space 60. In this case, when at least one of the plurality of refrigerant leakage sensors 70 detects a leakage of refrigerant, the refrigerant recovery operation can be started. Also for the refrigerant recovery operation having been described in the first embodiment (including a modification thereof) and the second embodiment, the functions are shared among air conditioning system controller 10, outdoor unit controller 30, indoor unit controller 50, and indoor remote controller 110, so that the main control unit thereof (controller 101) can be configured in any manner.

Furthermore, in each of the configurations in FIGS. 1, 12 and 13, any number of outdoor units 20 may be disposed while any number of indoor units 40 may be disposed. For example, a plurality of outdoor units 20 can be provided. Also, the number of indoor units 40 disposed so as to correspond to the number of outdoor units 20 is not limited to two, but may be one or may be any number. Similarly, the number of target spaces 60 and the number of indoor units 40 disposed in target space 60 may be one or may be any number.

It should be understood that the embodiments disclosed herein are illustrative and non-restrictive in every respect.

The scope of the present invention is defined by the terms of the claims, rather than the description above, and is intended to include any modifications within the meaning and scope equivalent to the terms of the claims.

The invention claimed is:

1. A refrigeration cycle apparatus equipped with an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe configured to connect the compressor, the outdoor heat exchanger, and the indoor heat exchanger in a circulation manner;

a first flow interruption valve provided in a portion of a refrigerant circulation path that does not pass through the compressor and that connects the outdoor heat exchanger and the indoor heat exchanger, the refrigerant circulation path being a path that includes the compressor, the outdoor heat exchanger, the indoor heat exchanger, and the refrigerant pipe;

a leakage sensor configured to detect a leakage of refrigerant that flows through the refrigerant pipe; and a notification output configured to output information to a user, wherein when the leakage sensor detects a leakage of the refrigerant, a refrigerant recovery operation is performed until a termination condition based on a predetermined state amount is satisfied, in the refrigerant recovery operation, the first flow interruption valve interrupts a flow of the refrigerant and the compressor is operated in a state where the refrigerant circulation path is formed in a direction in which the refrigerant discharged from the compressor passes through the outdoor heat exchanger and subsequently passes through the indoor heat exchanger, and when an abnormality in the refrigerant recovery operation is detected during the refrigerant recovery operation, the notification output outputs guidance information for notifying the user about the abnormality, the refrigeration cycle apparatus further comprises a pressure detector disposed on a suction side of the compressor, a state amount is a pressure detection value by the pressure detector, the termination condition is satisfied when the state amount decreases to the predetermined state amount, a predetermined reference time period is set in a time period until the refrigerant recovery operation normally ends, and when the state amount after a lapse of the predetermined reference time period is greater than the predetermined state amount, the notification output outputs the guidance information.

2. The refrigeration cycle apparatus according to claim 1, wherein the notification output is configured to output the guidance information when the refrigerant recovery operation does not end after a lapse of:

the predetermined reference time period from when the refrigerant recovery operation is started until when the refrigerant recovery operation ends in a state where the refrigerant recovery operation is normally performed; or a second reference time period longer than the predetermined reference time period.

3. The refrigeration cycle apparatus according to claim 2, wherein the predetermined reference time period or the second reference time period is set to be shorter at a lower temperature in accordance with a temperature state in each of the indoor unit and the outdoor unit.

4. The refrigeration cycle apparatus according to claim 1, wherein a change amount of the predetermined state amount per unit time in the refrigerant recovery operation normally performed is defined as a reference change amount, and when the predetermined change amount of the state amount per unit time is less than the reference change amount, the notification output outputs the guidance information.

5. A refrigeration cycle apparatus equipped with an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe configured to connect the compressor, the outdoor heat exchanger, and the indoor heat exchanger in a circulation manner;

a first flow interruption valve provided in a portion of a refrigerant circulation path that does not pass through the compressor and that connects the outdoor heat exchanger and the indoor heat exchanger, the refrigerant circulation path being a path that includes the compressor, the outdoor heat exchanger, the indoor heat exchanger, and the refrigerant pipe;

a leakage sensor configured to detect a leakage of refrigerant that flows through the refrigerant pipe; and a notification output configured to output information to a user, wherein when the leakage sensor detects a leakage of the refrigerant, a refrigerant recovery operation is performed until a termination condition based on a predetermined state amount is satisfied, in the refrigerant recovery operation, the first flow interruption valve interrupts a flow of the refrigerant and the compressor is operated in a state where the refrigerant circulation path is formed in a direction in which the refrigerant discharged from the compressor passes through the outdoor heat exchanger and subsequently passes through the indoor heat exchanger, when an abnormality in the refrigerant recovery operation is detected during the refrigerant recovery operation, the notification output outputs guidance information for notifying the user about the abnormality, the leakage sensor is configured to detect a refrigerant concentration of the refrigerant in atmosphere, a state amount is a detection value of the refrigerant concentration, and the termination condition is satisfied when the refrigerant concentration decreases to the predetermined state amount.

6. The refrigeration cycle apparatus according to claim 5, wherein the notification output is configured to output the guidance information when the refrigerant recovery operation does not end after a lapse of:

a first reference time period from when the refrigerant recovery operation is started until when the refrigerant recovery operation ends in a state where the refrigerant recovery operation is normally performed; or a second reference time period longer than the first reference time period.

7. The refrigeration cycle apparatus according to claim 6, wherein the first reference time period or the second reference time period is set to be shorter at a lower temperature in accordance with a temperature state in each of the indoor unit and the outdoor unit.

8. The refrigeration cycle apparatus according to claim 5, wherein the predetermined state amount after a lapse of a third reference time period from start of the refrigerant recovery operation in the refrigerant recovery operation normally performed is defined as a reference state amount, the third reference time period is set in a time period until the refrigerant recovery operation ends, and when the state amount after a lapse of the third reference time period is greater than the predetermined state amount, the notification output outputs the guidance information.

9. A refrigeration cycle apparatus equipped with an outdoor unit and at least one indoor unit, the refrigeration cycle apparatus comprising:

a compressor;

an outdoor heat exchanger provided in the outdoor unit;

an indoor heat exchanger provided in the indoor unit;

a refrigerant pipe configured to connect the compressor, the outdoor heat exchanger, and the indoor heat exchanger in a circulation manner;

a first flow interruption valve provided in a portion of a refrigerant circulation path that does not pass through the compressor and that connects the outdoor heat exchanger and the indoor heat exchanger, the refrigerant circulation path being a path that includes the compressor, the outdoor heat exchanger, the indoor heat exchanger, and the refrigerant pipe;

a leakage sensor configured to detect a leakage of refrigerant that flows through the refrigerant pipe; and a notification output configured to output information to a user, wherein when the leakage sensor detects a leakage of the refrigerant, a refrigerant recovery operation is performed until a termination condition based on a predetermined state amount is satisfied, in the refrigerant recovery operation, the first flow interruption valve interrupts a flow of the refrigerant and the compressor is operated in a state where the refrigerant circulation path is formed in a direction in which the refrigerant discharged from the compressor passes through the outdoor heat exchanger and subsequently passes through the indoor heat exchanger, when an abnormality in the refrigerant recovery operation is detected during the refrigerant recovery operation, the notification output outputs guidance information for notifying the user about the abnormality, the refrigeration cycle apparatus further comprises:

a pressure detector disposed on a discharge side of the compressor;

an accumulator in which the refrigerant in a liquid state is accumulated, the accumulator being disposed between the outdoor heat exchanger and the first flow interruption structure in the refrigerant circulation path; and a temperature detector disposed between the accumulator and the first flow interruption valve in the refrigerant circulation path, a state amount is a degree of supercooling calculated using a pressure detection value obtained by the pressure detector and a temperature detection value obtained by the temperature detector, and the termination condition is satisfied when the degree of supercooling increases to the predetermined state amount.

10. The refrigeration cycle apparatus according to claim 9, wherein the notification output is configured to output the guidance information when the refrigerant recovery operation does not end after a lapse of:

a first reference time period from when the refrigerant recovery operation is started until when the refrigerant recovery operation ends in a state where the refrigerant recovery operation is normally performed; or a second reference time period longer than the first reference time period.

11. The refrigeration cycle apparatus according to claim 10, wherein the first reference time period or the second reference time period is set to be shorter at a lower temperature in accordance with a temperature state in each of the indoor unit and the outdoor unit.

12. The refrigeration cycle apparatus according to claim 9, wherein the predetermined state amount after a lapse of a third reference time period from start of the refrigerant recovery operation in the refrigerant recovery operation normally performed is defined as a reference state amount, the third reference time period is set in a time period until the refrigerant recovery operation ends, and when the state amount after a lapse of the third reference time period is less than the predetermined state amount, the notification device outputs the guidance information.

13. The refrigeration cycle apparatus according to claim 9, further comprising a four-way valve having a first port, a second port, a third port, and a fourth port, wherein the four-way valve is controlled to bring about one of:

a first state allowing communication between the first port and the fourth port and allowing communication between the second port and the third port; and a second state allowing communication between the first port and the second port and allowing communication between the third port and the fourth port, the first port of the four-way valve is connected to a suction side of the compressor, the second port of the four-way valve is connected to a path leading to the outdoor heat exchanger, the third port of the four-way valve is connected to a discharge side of the compressor, the fourth port of the four-way valve is connected to a path leading to the indoor heat exchanger, and the four-way valve is controlled to bring about the first state in the refrigerant recovery operation.

14. The refrigeration cycle apparatus according to claim 13, further comprising a second interruption valve disposed between the fourth port and the indoor heat exchanger in the refrigerant circulation path, wherein the second flow interruption valve is controlled to bring about an interruption state when the compressor is stopped to end the refrigerant recovery operation.

15. The refrigeration cycle apparatus according to claim 13, further comprising an accumulator disposed between the first port and the suction side of the compressor, wherein the four-way valve is controlled to bring about the second state when the compressor is stopped to end the refrigerant recovery operation.

* * * * *